US008764618B2

(12) United States Patent
Castro et al.

(10) Patent No.: US 8,764,618 B2
(45) Date of Patent: Jul. 1, 2014

(54) CLAMPLESS BAR MECHANISM FOR A PAPER BAG BOTTOMING MECHANISM

(75) Inventors: Noe Yañez Castro, Tamaulipas (MX); Guadalupe Acevedo, Brownsville, TX (US); Cipriano Hinojosa, McAllen, TX (US)

(73) Assignee: Duro Bag Manufacturing Company, Florence, KY (US)

( * ) Notice: Subject to any disclaimer, the term of this patent is extended or adjusted under 35 U.S.C. 154(b) by 626 days.

(21) Appl. No.: 13/014,948

(22) Filed: Jan. 27, 2011

(65) Prior Publication Data

US 2012/0196732 A1 Aug. 2, 2012

(51) Int. Cl.
*B31B 29/00* (2006.01)

(52) U.S. Cl.
CPC ..... *B31B 29/00* (2013.01); *B31B 2219/028* (2013.01); *B31B 2221/20* (2013.01); *B31B 2221/402* (2013.01)
USPC ..... 493/243; 493/258; 493/259; 493/260

(58) Field of Classification Search
CPC ..... B31B 29/00; B31B 29/74; B31B 37/00; B31B 2219/026; B31B 2219/028; B31B 2219/26; B31B 2219/2645; B31B 2219/2654; B31B 2219/2672; B31B 2219/2681; B31B 2221/20; B31B 2221/40; B31B 2221/402; B31B 2221/60
USPC ..... 493/243, 257, 258, 259, 260
See application file for complete search history.

(56) References Cited

U.S. PATENT DOCUMENTS

| | | | | | |
|---|---|---|---|---|---|
| 327,280 | A | * | 9/1885 | Leinbach et al. | 493/259 |
| 635,090 | A | * | 10/1899 | Claussen et al. | 493/258 |
| 759,786 | A | * | 5/1904 | Westervelt | 493/259 |
| 813,280 | A | * | 2/1906 | Claussen | 493/258 |
| 832,850 | A | * | 10/1906 | Dulin et al. | 493/258 |
| 940,534 | A | * | 11/1909 | King | 493/258 |
| 1,057,377 | A | * | 3/1913 | Dulin | 493/262 |

(Continued)

FOREIGN PATENT DOCUMENTS

| | | | | |
|---|---|---|---|---|
| DE | 668074 C | * | 11/1938 | B31B 2221/402 |
| DE | 1 082 104 | | 5/1960 | |

(Continued)

OTHER PUBLICATIONS

Search Report, from European patent application No. 12151129.9 with a filing date of Jan. 13, 2012, mailed by the European Patent Office on Nov. 15, 2012, 6 pages.

(Continued)

*Primary Examiner* — Stephen F Gerrity
(74) *Attorney, Agent, or Firm* — Baker & Hostetler LLP

(57) ABSTRACT

A paper bag bottoming mechanism having a bottoming drum having a first end, a second end, and a sidewall disposed therebetween, a bar affixed to the bottoming drum, the bar having a first end and a second end, a first guide block attached to the first end of the bar and a second guide block attached to the second end of the bar, a first slideable finger attached to the first guide block and a second slideable finger attached to the second guide block, and a first actuating mechanism communicating with the first slideable finger for actuating the first slideable finger and a second actuating mechanism communicating with the second slideable finger for actuating the second slideable finger. Also disclosed is a method for making a using a clampless bar mechanism.

7 Claims, 23 Drawing Sheets

(56) References Cited

U.S. PATENT DOCUMENTS

| | | | | | |
|---|---|---|---|---|---|
| 1,058,806 | A | | 4/1913 | Stilwell | |
| 1,069,397 | A | * | 8/1913 | Dulin | 493/258 |
| 1,571,983 | A | * | 2/1926 | Weber | 493/229 |
| 2,126,920 | A | | 8/1938 | Potdevin | |
| 2,324,358 | A | * | 7/1943 | Burroughs | 493/260 |
| 2,333,440 | A | | 11/1943 | Potdevin | |
| 2,847,914 | A | | 8/1958 | Davis | |
| 2,985,355 | A | | 5/1961 | Read | |
| 3,590,696 | A | | 7/1971 | Reissner et al. | |
| 3,833,446 | A | * | 9/1974 | Class | 493/190 |
| 3,861,124 | A | | 1/1975 | Bentzien | |
| 5,609,556 | A | | 3/1997 | Rostalski et al. | |
| 6,932,754 | B2 | | 8/2005 | Fujishiro et al. | |
| 7,254,930 | B2 | | 8/2007 | Bartel et al. | |
| 7,678,037 | B2 | | 3/2010 | Campbell | |
| 2005/0176569 | A1 | | 8/2005 | Wold et al. | |

FOREIGN PATENT DOCUMENTS

| | | | | |
|---|---|---|---|---|
| DE | 1082104 | | 5/1960 | |
| DE | 10344156 | B4 * | 2/2008 | B31B 2221/402 |
| JP | 2002-114233 | | 4/2002 | |

OTHER PUBLICATIONS

H.G. Weber & Co., Inc. Weber Variable Size S.O.S. Operator'S Manual; (No Date); pp. 1-68.

H.G. Weber & Co., Inc.; *Flexible packaging Machinery*; Service Bulletin—Pivoting Second Tuck Assemby for 800 Series Machines; Form 00-11-0702; © 2000 HGW;p. 1.

H.G. Weber & Co., Inc.; *Flexible packaging Machinery*; Service Bulletin—Back Flap Closing Assembly for 800 Series Machines; Form 00-13-0702; © 2000 HGW; p. 1.

H.G. Weber & Co., Inc.; *Flexible packaging Machinery*; Service Bulletin—New Lower Scoring Cylinder; Form 01-08; © 2001 HGW; p. 1.

H.G. Weber & Co., Inc.; *Flexible packaging Machinery*; Service Bulletin—Drum Setup Gauge Specifications and Tuck Blade Setup; Form 70-1 (1-09); © 2000 HGW; p. 1.

H.G. Weber & Co., Inc.; Service Bulletins—We've Exploded Our Drum Finger! to show its assembly, operation and adjustment; Form 70-2; (No Date) p. 1.

H.G. Weber & Co., Inc.; Service Bulletins—Second Score Line, Acts As Hinge When Folding Bag Bottom; Form 72-2; Second Score Line, Quick Location Check; Form 72-4; (No Date)pp. 1-2.

H.G. Weber & Co., Inc.; Service Bulletins—Tucking Cylinder, for Adjustable Machines 5-7; Form 71-3; (No Date) p. 1.

H.G. Weber & Co., Inc.; Service Bulletins—Second Drum Clamp, for Weber Adjustable Machines 2-3; Form 71-4; p. 1.

H.G. Weber & Co., Inc.; Service Bulletins—Second Drum Clamp, for Weber Adjustable Machines 5-7; Form 71-5; (No Date) p. 1.

H.G. Weber & Co., Inc.; Service Bulletins—Drum Finger Installation and Adjustment, for Weber Variable Size Machines 2-3-5-7; Form 83-3; (No Date) p. 1.

H.G. Weber & Co., Inc.; Service Bulletins—Drum Finger Spider, Has This Ever Happened to You?; Form 85-3; (No Date) p. 1.

H.G. Weber & Co., Inc.; Service Bulletins—Extended Finger Tips; Form 93-2; (No Date) p. 1.

Extended European search report dated Sep. 18, 2013, from European patent application No. 12151129.9 with a filing date of Jan. 13, 2012, mailed from the European Patent Office, Munich, Germany, 13 pages.

* cited by examiner

CLAMPLESS BAR MECHANISM FOR A PAPER BAG BOTTOMING MECHANISM

FIELD OF THE INVENTION

The present invention relates generally to a mechanism and method for manufacturing paper bags. More specifically, the invention relates to a clampless bar mechanism and method for manufacturing paper bags.

BACKGROUND OF THE INVENTION

Paper bags are often made with a bag making system from a roll or web of paper. The bag making system forms, folds and pastes the paper web into finished paper bags. While making a bag, a bag making machine must grasp parts of the paper bag to facilitate folding and sealing the bottom of the paper bag. One method commonly used to grasp the bags uses clamps with corresponding tucker blades. These clamps typically crease the face of the paper bag, detracting from the appearance of the face of the bag.

To avoid the crease in the face of the bag, the bags may be hand-made. While hand-made bags may be visually appealing, they are labor intensive and can be expensive to make. What is needed is a mechanism and method for machine making paper bags without causing the crease mark in the face of the paper bag.

SUMMARY OF THE INVENTION

The present invention relates to a bag bottoming mechanism comprising a bottoming drum having a first end, a second end, and a sidewall disposed therebetween, a bar affixed to the bottoming drum, the bar having a first end and a second end, a first guide block attached to the first end of the bar and a second guide block attached to the second end of the bar, a first slideable finger attached to the first guide block and a second slideable finger attached to the second guide block, and a first actuating mechanism communicating with the first slideable finger for actuating the first slideable finger, and a second actuating mechanism communicating with the second slideable finger for actuating the second slideable finger.

The invention further relates to a bag bottoming mechanism comprising a bottoming drum having a first end, a second end, and a sidewall disposed therebetween, a first cut gusseted tube securing mechanism disposed between the first end and the second end of the bottoming drum, a second cut gusseted tube securing mechanism having a first slideable finger disposed on the first end of the bottoming drum and a second slideable finger disposed on the second end of the bottoming drum opposite the first slideable finger, and a first actuating mechanism communicating with the first slideable finger for actuating the first slideable finger and a second actuating mechanism communicating with the second slideable finger for actuating the second slideable finger.

The invention relates also to a method of closing the bottom of a cut gusseted tube to form a paper bag comprising gripping a leading end of a cut gusseted tube with a gripper affixed to a bottoming drum of a paper bag making machine, sliding at least one first slideable finger over the cut gusseted tube to hold the cut gusseted tube between the first slideable finger and the bottoming drum located on the paper bag making machine, rotating the bottoming drum, applying paste to the cut gusseted tube while the cut gusseted tube rotates with the bottoming drum, folding a cut gusseted tube inner flap with a bottom closing roller, folding a cut gusseted tube outer flap, and discharging a bag.

DETAILED DESCRIPTION OF THE INVENTION

An overview of the primary components and operation of a typical bag making system and method are described below. Unless otherwise noted in the application, the term bags refers to paper bags. Paper bags can be made from many different types of materials, including brown kraft, clay coat, laminated materials, white kraft, and recycled paper, among other paper materials.

Figure 1:
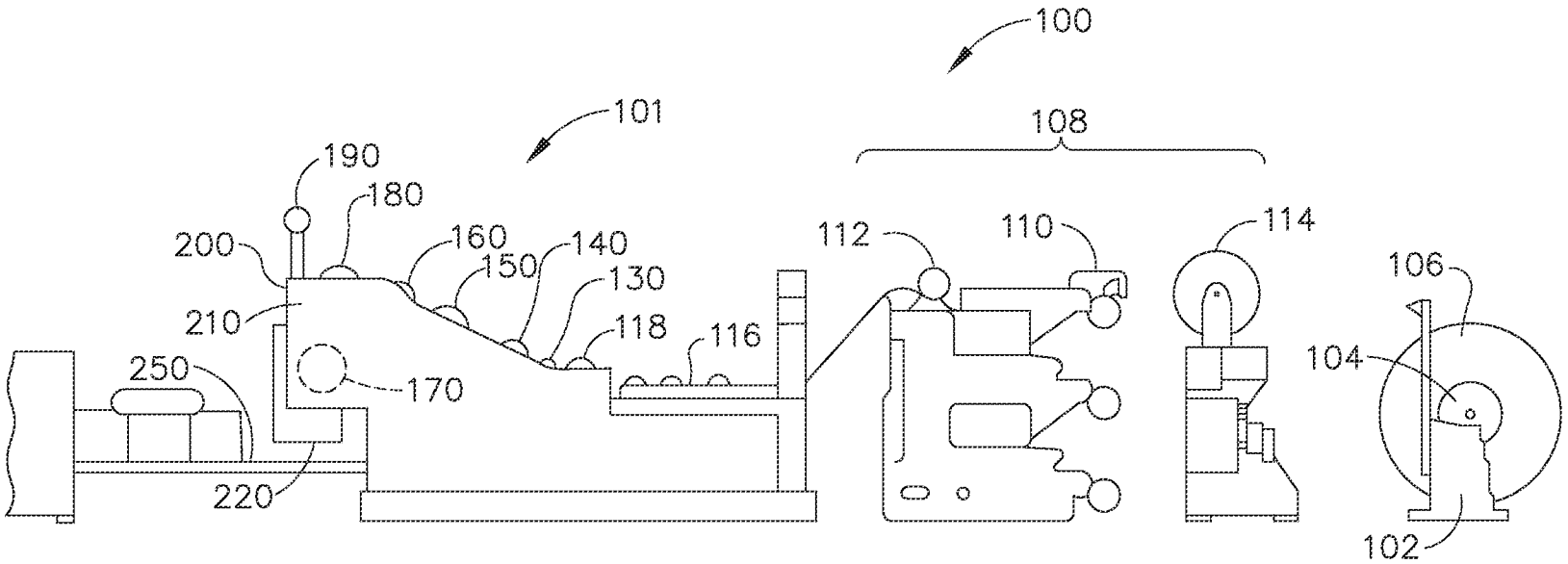
FIG. 1 is a diagram of a bag making system.

FIG. 1 shows a schematic of a bag making system 100. A rollstand 102 supports a spindle 104 on which a paper roll 108 is mounted. A web end section 108 contains two primary systems, an interply pasting system 110 and a seam pasting system 112. A laminator 114 is used with the interply pasting system when running two or three-ply bags. A rotating paste section applies a glue pattern to the inner surface of the paper ply (or plies). The pasted plies are compressed as they run between rollers in the web end. The seam pasting system 112 applies a continuous line of paste to the edge of each paper ply.

A bag making machine 101 is part of the bag making system 100. A former section 116 contains devices that form the flat sheet of paper into a gusseted tube. A paper guide bracket and former rib begin forming the sheet into a tube. Side tucking plates and former plates begin the formation of the two side gussets. Weighted rollers compress the overlapped seam to complete the tube seam. Two slitter knives and a lip knife 118 place cuts in the tube at prescribed positions.

Drawrolls 130 have two solid cylinders with knurled outer surfaces to provide the required grip and pressure to advance the tube. The drawrolls pull the paper web(s) from the rollstand(s), through the web end and former sections, and advance the tube to the transfer cylinder as a cutoff cylinder cuts the tube.

Cutoff cylinders 140 sever the gusseted tube from the paper web and provide the correct tube length. Transfer cylinders 150 transport the cut gusseted tube from the cutoff cylinders to the scoring cylinder.

A scoring station 160 places two creases (scores) widthwise across the cut gusseted tube. The cut gusseted tube is transported on a rotating bottoming drum 170 while the bottom of the cut gusseted tube is opened, pasted, closed, and pressed. The bottoming drum can have one, two, three or four stations, or more, the number of stations dictating the number of bags made per bottoming drum revolution. An opening cylinder 180 rotates above the bottoming drum while its fingers extend into the upper face of the cut gusseted tube. Once the bottom of the cut gusseted tube is opened, the fingers retract to allow the cut gusseted tube to continue on the bottoming drum.

A bottom folder 190 folds the open bottom down against the bottoming drum as the cut gusseted tube leaves the opening cylinder. A bottom paste section 200 applies a U-shaped paste pattern to the open bottom of the cut gusseted tube. A tucking cylinder 210 contains tucking blades which force the open bottom portion into open first and second bottoming drum clamps.

A bottom closing section 220 comprises of a bottom closing roller and stationary bottom closing plate. Two stripping plates direct the completed bags away from the bottoming drum and into bag carrier belts 250. The bag carrier belts 250 transfer the bags from the bag machine to a delivery table for inspection.

Figure 5A:
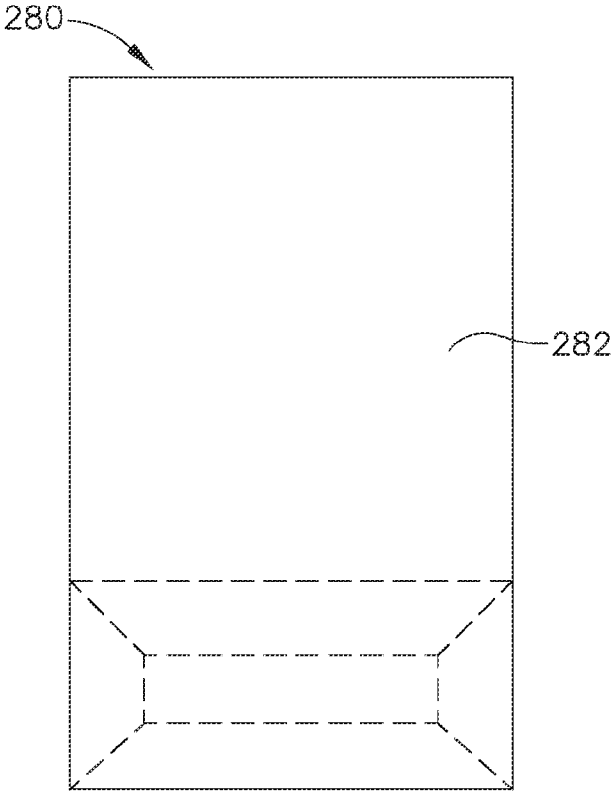
FIG. 5A is a front view of a paper bag made using a clampless bar mechanism and method of making a paper bag according to the invention.
Figure 5B:
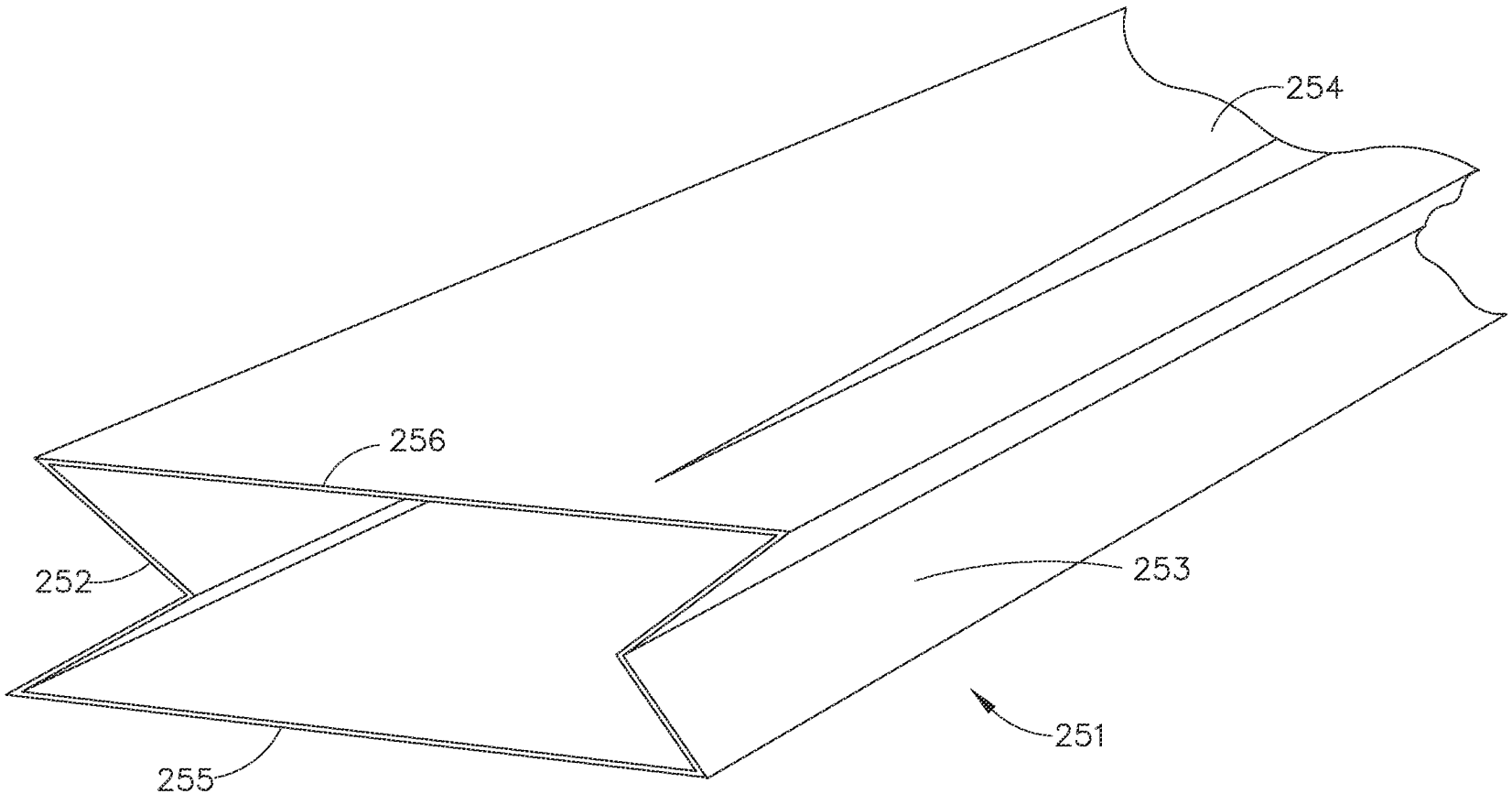
FIG. 5B is perspective view of a gusseted paper tube.

FIG. 5B shows a gusseted tube 251 formed from a continuous web of paper by the web end 108 of the bag making system and the former section 116 of the bag making machine. The gusseted tube has gusseted sides 252 and 253, a pasted seam 254, an upper ply leading end 256, and a lower ply leading end 255.

Figure 3:
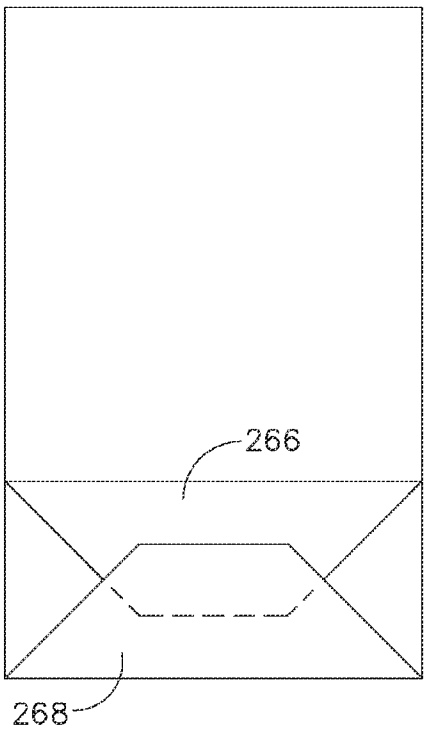
FIG. 3 is a back view of a paper bag with the inner and outer flaps folded.
Figure 2:
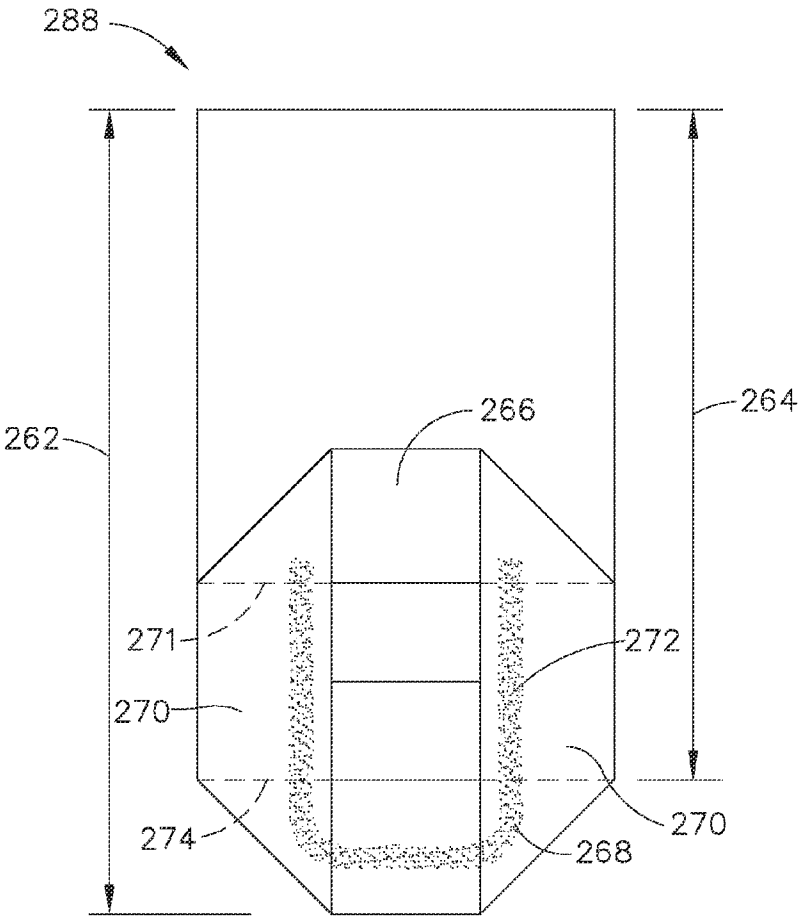
FIG. 2 is a back view of a paper bag with the inner and outer flaps unfolded.
Figure 4:
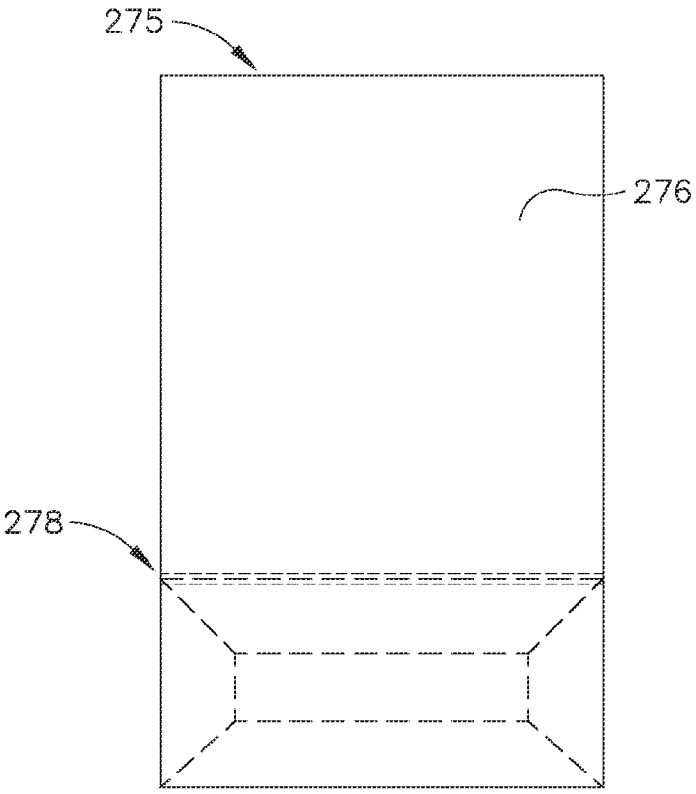
FIG. 4 is front view of a paper bag showing a crease caused by a clamp.

FIG. 2 shows a cut gusseted tube 288 cut from a gusseted tube 251. The cut gusseted tube 288 has a cut gusseted tube length 262, a completed bag length 264, an inner flap 266, an outer flap 268, bottom side folds 270, and paste pattern 272. This cut gusseted tub 288 also has a crease line 274 created by a first clamp (described later) and a fold line 271. FIG. 3 shows a bag 260 after the inner flap 266 and the outer flap 268 have been folded and pasted. In FIG. 4, a front face 276 of a bag 275 is interrupted by a crease 278 caused by the second bottoming drum clamp. FIG. 5A shows a bag 280 made by a method of the invention. A front face 282 of the bag is smooth with no crease caused by a second clamp.

Figure 6:
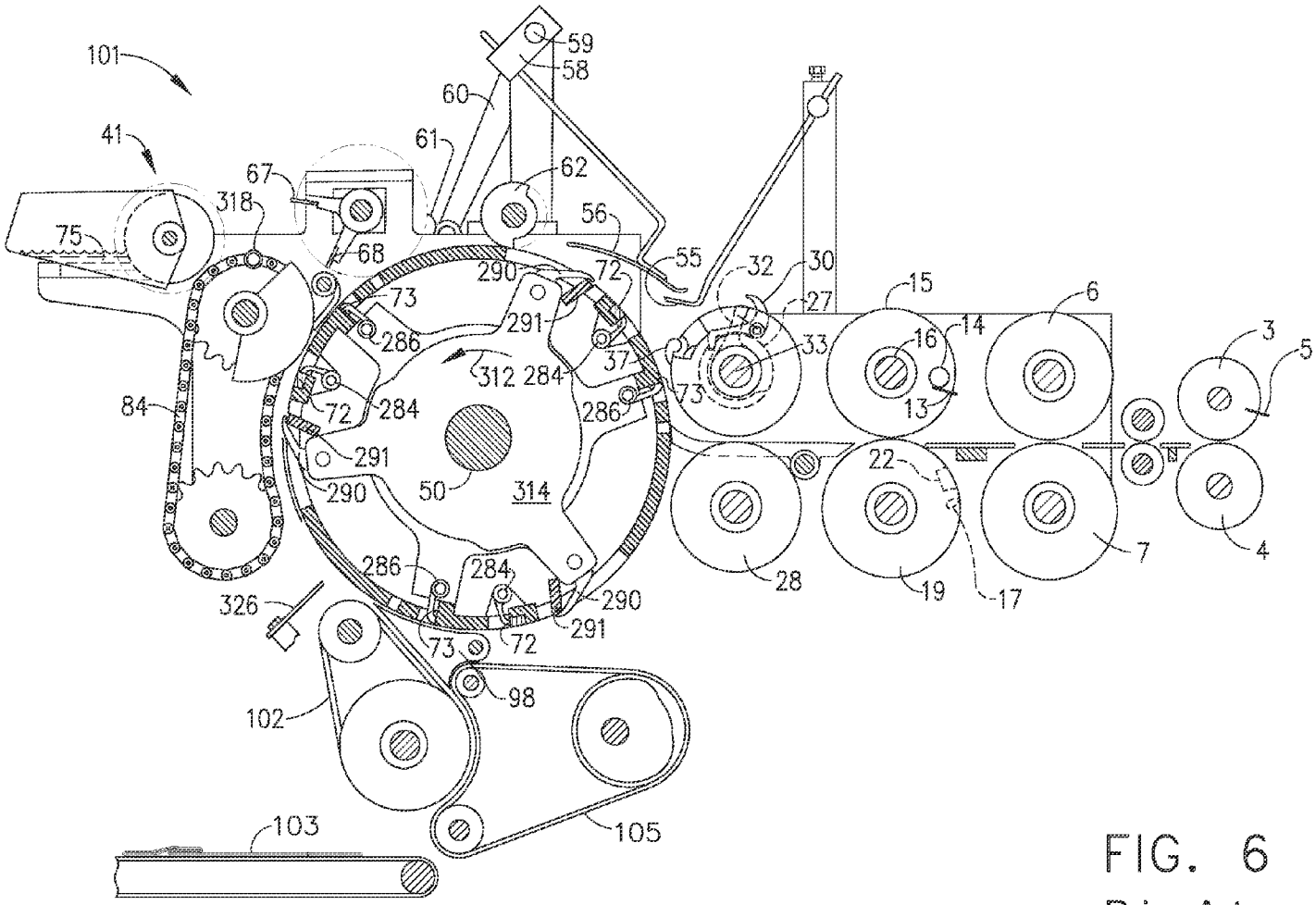
FIG. 6 Prior Art
FIG. 6 is a drawing of a type of paper bag making machine.

One type of paper bag making machine is described in U.S. Pat. No. 2,126,920, which is incorporated by reference in its entirety. FIG. 6 shows a bag making machine described in U.S. Pat. No. 2,126,920. The bag making machine 101 receives a previously gusseted tube as shown in FIG. 5B. The uncut gusseted tube passes through an upper cutoff cylinder 3 and a lower cutoff cylinder 4 where the gusseted tube is cut by a knife 5 to a predetermined length determined by the diameter of the cutoff cylinders. Transfer cylinders 6 and 7 move the cut gusseted tube forward towards upper scoring discs 15 and lower scoring cylinder 19. A rotating scoring mechanism comprises a thin scoring blade 13 mounted on an adjustable shaft 14 carried in discs 15 on a shaft 16. The lower disc cylinder 19 carries an abutment 22 which cooperates with a movable jaw 17. In operation, the blade 13 depresses the wall of the cut gusseted tube length between the jaw 17 and the abutment 22. The scoring discs 15 and cylinder 19 release the tube after the scoring operation is completed, and the cut gusseted tube is forwarded by the rotating scoring mechanism between opening discs 27 and cooperating lower cylinder 28.

As the leading end of the cut gusseted tube reaches the opening station, a cam-and-spring operated gripper 30 carried by one of the discs 27 takes hold of upper ply leading end 256 of the cut gusseted tube, clamping it against cooperating abutment 32 on a shaft 33 to which the discs 27 are mounted.

A bottoming drum 314 is mounted to a shaft 50 and carries a plurality of center grippers 290 which are adapted to grip lower ply leading end 255 of the cut gusseted tube as the cut gusseted tube comes up to the bottoming drum. Center gripper 290 grips the lower ply leading end 255 of the cut gusseted tube against a cooperating abutment 291. The bottom of the cut gusseted tube is opened as the bottoming drum rotates in the direction of arrow 312 while the center gripper 290 holds the lower ply leading end 255 of the cut gusseted tube and the gripper 30 holds the upper ply leading end 256 of the cut gusseted tube. These grippers are affixed to the bottoming drum and are spring actuated and cam released.

After the upper ply leading end of the cut gusseted tube has been gripped by a gripper 290 and opened sufficiently, the gripper 30 releases its hold and the upper ply leading end 256 of the cut gusseted tube is engaged by a stationary curved finger 55, thus holding the cut gusseted tube open. The finger 55 remains in contact with the upper ply leading end of the cut gusseted tube until fingers 56 descend to flatten the partially open cut gusseted tube against the bottoming drum. The function of the fingers 56 is to fold over and fold down the edges of the cut gusseted tube, resulting in a folded cut gusseted tube as shown in FIG. 2.

The fingers 56 are carried by a short arm 58 adjustably mounted on a rod 59, which is moved by way of a lever 60 having a cam follower riding on a cam 61. Typically, the fingers 56 are curved to the contour of the bottoming drum.

The cut gusseted tube, which now has been folded and which is being held by center gripper 290, advances to and under a segmented roller 62, where it is subjected to a further ironing or flattening operation. Alternatively, the roller 62 may be a non-segmented roller.

The cut gusseted tube now advances to the pasting and tucking mechanisms. The bottom tucking mechanism comprises tucking blades 67 and 68, a first clamp 284 and a second clamp 286. The bottoming drum 314 holds three pairs of such clamps, but fewer or more pairs of clamps may be used. The first clamp 284 and second clamp 286 are spring-closed and cam-released.

As the cut gusseted tube rides on the bottoming drum, the first clamp 284 and the second clamp 286 are held closed by their respective springs. When the cam followers that actuate the clamps ride up on a cam lobe (not shown), the clamps are opened so they are in the open position when they arrive at the cooperating tucking blades 67 and 68.

Figure 8A:
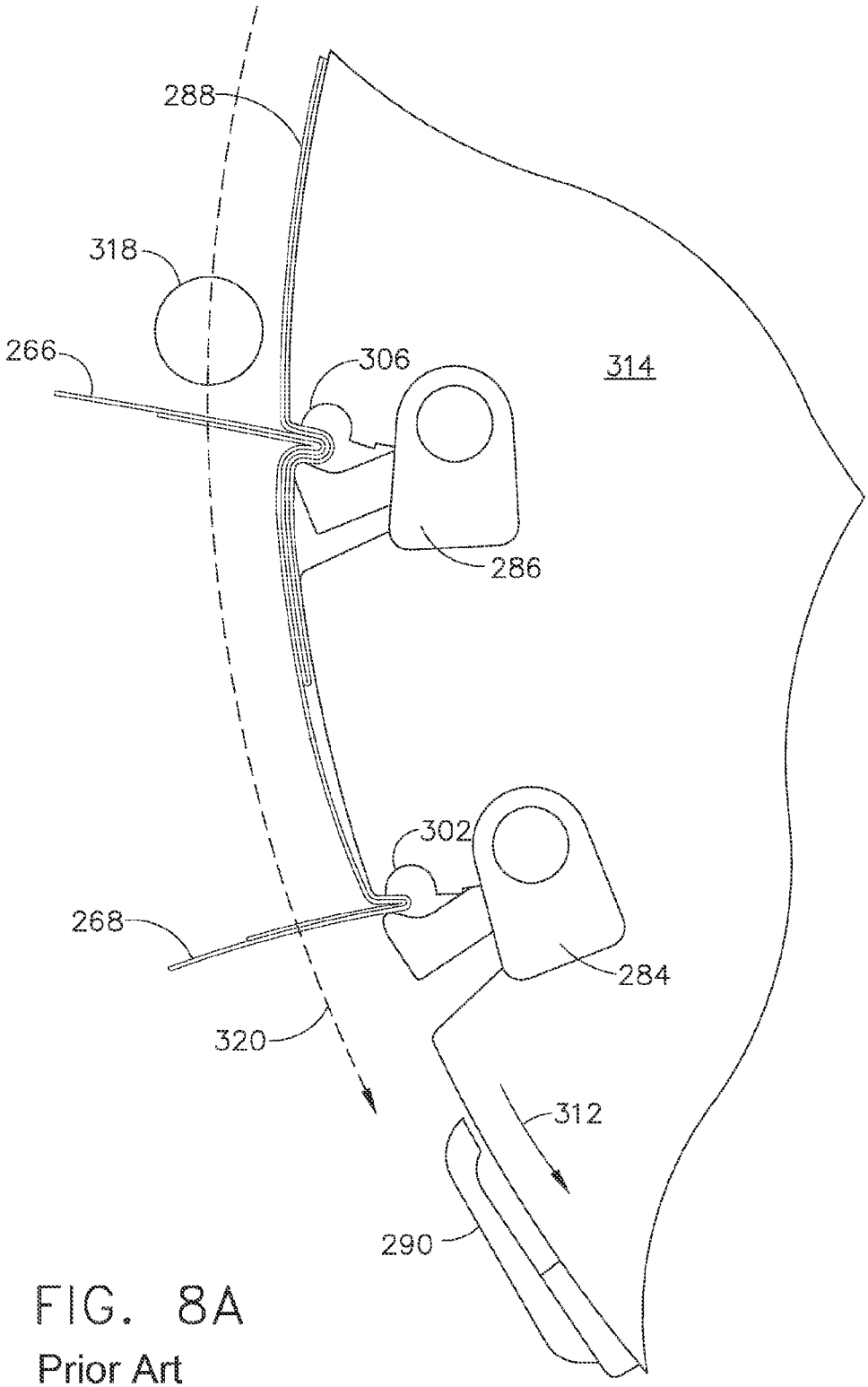
FIG. 8A Prior Art
FIG. 8A is a drawing showing a bottom folding roller starting to fold the inner flap of a paper bag.

The tucking blade 67 first engages the cut gusseted tube width and forces the cut gusseted tube toward the bottoming drum between first clamp 284 and cooperating abutment 72, and the first clamp closes. As the bottoming drum holding the cut gusseted tube continues to rotate in the direction of arrow 312, the tucking blade 68 forces the cut gusseted tube between the second clamp 286 and its cooperating abutment 73, and the second clamp closes. The second clamp causes crease 278 shown in bag 275, FIG. 4, when it clamps the cut gusseted tube. Clamping the cut gusseted tube in the second clamp causes inner flap 266 to spring outwardly from the bottoming drum, as shown in FIG. 8A. Typically, the gripper 290 continues to hold outer flap 268, so it does not yet spring outwardly from the bottoming drum. The cut gusseted tube then moves to paste-applying station 41 where paste 75 is applied to the face.

The inner flap 266, extending outwardly from the crease 278 made by the second clamp 286, is then folded. A bottom closing roller 318 carried by a chain 84 moves downwardly at a higher speed than the cut gusseted tube. Traveling downward, the bottom closing roller folds the inner flap against bottom side folds 270. FIGS. 8A-8D show a detailed operation of the bottom closing roller folding an inner flap.

While bottom closing roller 318 folds the inner flap, the outer flap 268 continues to be gripped and held down by center gripper 290. By the time the folding of the inner flap is completed, the center gripper 290 will have released the outer flap, and the outer flap will spring outwardly away from the bottoming drum and be engaged by bottom closing plate 326. Alternatively, the center gripper 290 may release prior to the folding of the inner flap. As the cut gusseted tube continues to rotate on the bottoming drum, the bottom closing plate 326 folds the outer flap 268 against the previously folded inner flap 266.

The first clamp 284 then releases the cut gusseted tube, and as the cut gusseted tube continues to advance, fingers 98 strip the completed bag from the rotating bottoming drum. The bag passes between the fingers 98 and a belt 102, continuing to move forward between pressing belt 105 and belt 102. The bag is then discharged onto discharge belt 103.

Figure 7:
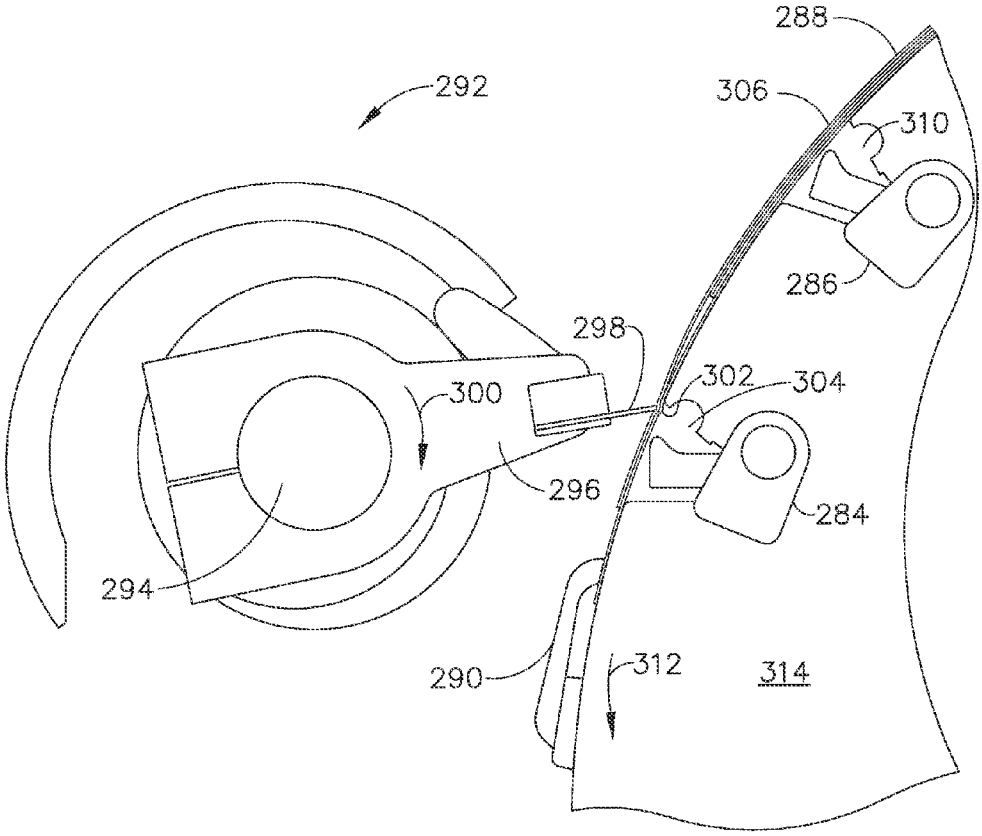
FIG. 7 Prior Art
FIG. 7 is a drawing of a tucking mechanism and corresponding clamps.

FIG. 7 shows an exploded view of a cut gusseted tube 288 disposed on a bottoming drum 314. The bottoming drum has a center gripper 290, a first clamp 284, and a second clamp 286. A tucker blade mechanism 292 rotates on a shaft 294 and has a tucker bracket 296 and a tucker blade 298. The tucker blade 298, connected to the tucker bracket 296 rotating in the direction of arrow 300, will push a first creasing area 302 of the cut gusseted tube 288 into an open clamp area 304 of the first clamp 284. As the bottoming drum continues to rotate in the direction of arrow 312 and the shaft 294 rotates in the direction of arrow 300, a second tucker blade (not shown) connected to a second tucker bracket (not shown) also affixed to the shaft 294 and rotating in the direction of arrow 300, will push a second creasing area 306 into an open clamp area 310 of the second clamp 286. When the second clamp 286 grips the cut gusseted tube 288, it creases the front face of the bag as shown by crease 278 in FIG. 4.

FIGS. 8A through 8D show the typical operations for closing the bottom of a cut gusseted tube using a bottoming drum with a first and second clamp. In FIG. 8A the first clamp 284 and the second clamp 286 have clamped onto the cut gusseted tube 288 at the first creasing area 302 and second creasing area 306, causing the inner flap 266 and the outer flap 268 of the cut gusseted tube to protrude outwardly from the bottoming drum. The outer flap 268 protrudes outwardly after the center gripper 290 has released the outer flap, which may occur at any time after the first clamp 284 has secured the cut gusseted tube 288 to the bottoming drum 314. The bottoming drum 314 rotates in the direction of arrow 312. The bottom closing roller 318, attached to the chain of a bottom closing mechanism (not shown), moves in the direction of arrow 320. The bottom closing roller 318 typically moves about four times as fast as the bottoming drum.

Figure 8B:
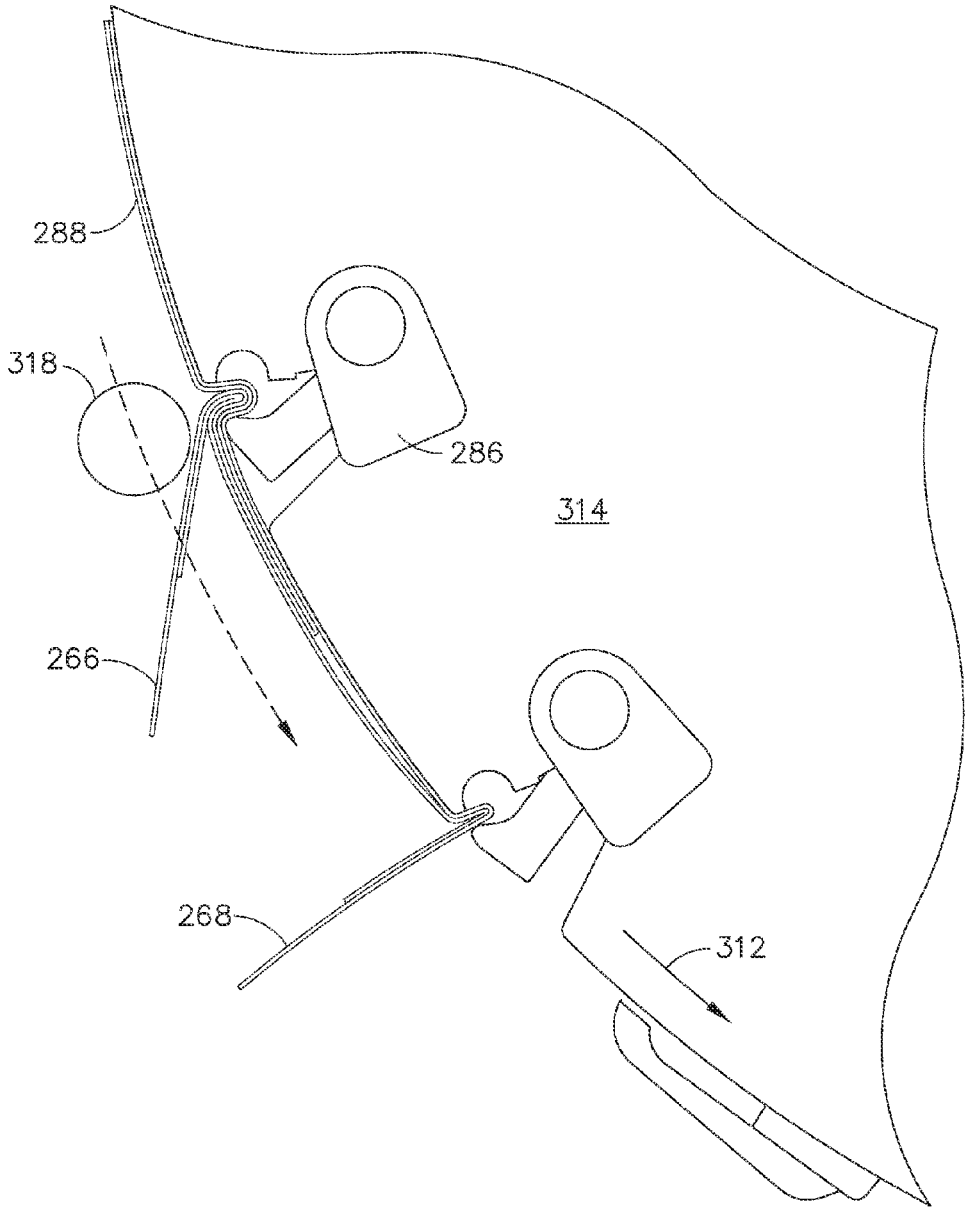
FIG. 8B Prior Art
FIG. 8B is a drawing showing the bottom folding roller folding the inner flap of a paper bag.
Figure 8C:
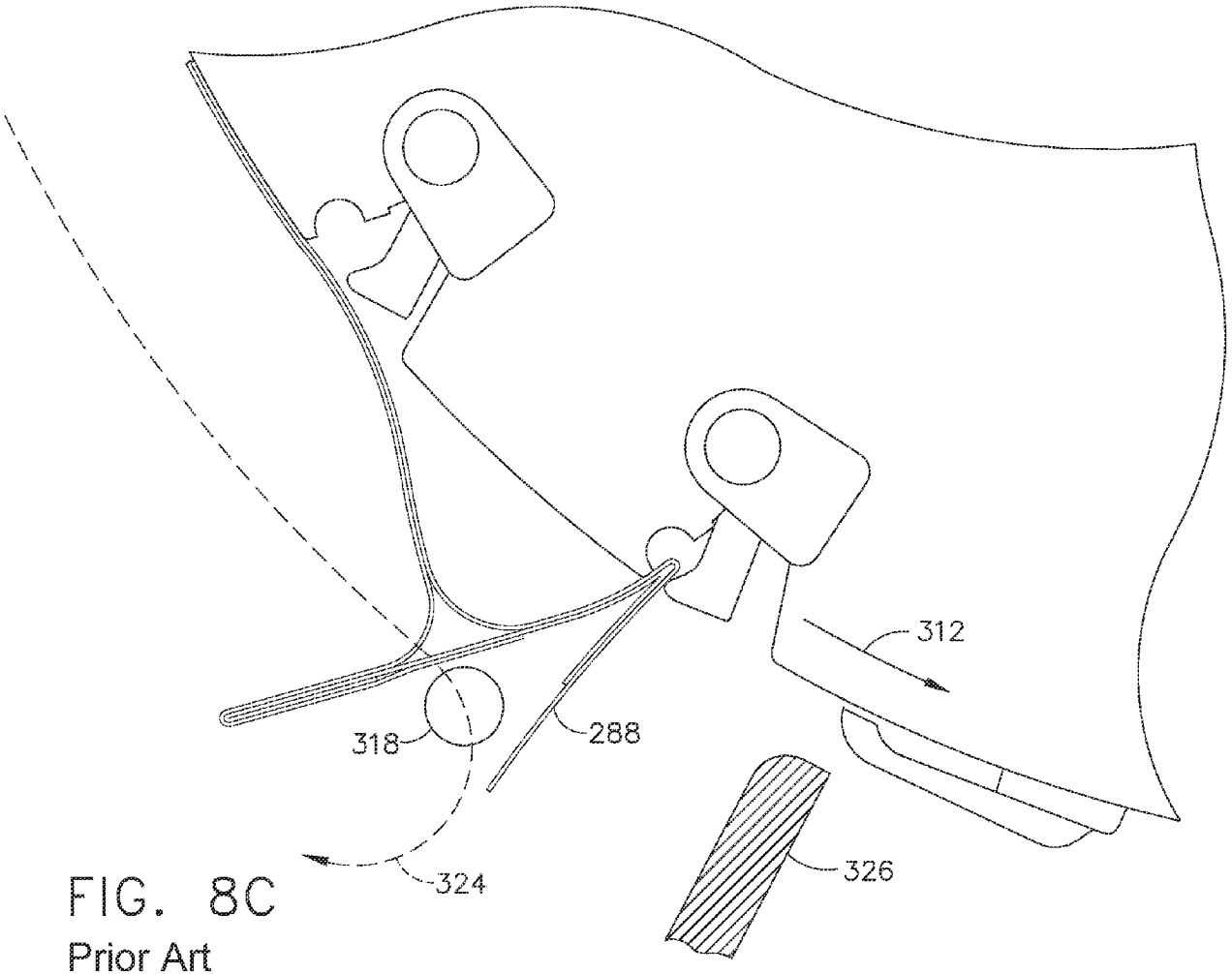
FIG. 8C Prior Art
FIG. 8C is a drawing showing the bottom folding roller moving away from a bottoming drum after it has folded the inner flap of a paper bag.
Figure 8D:
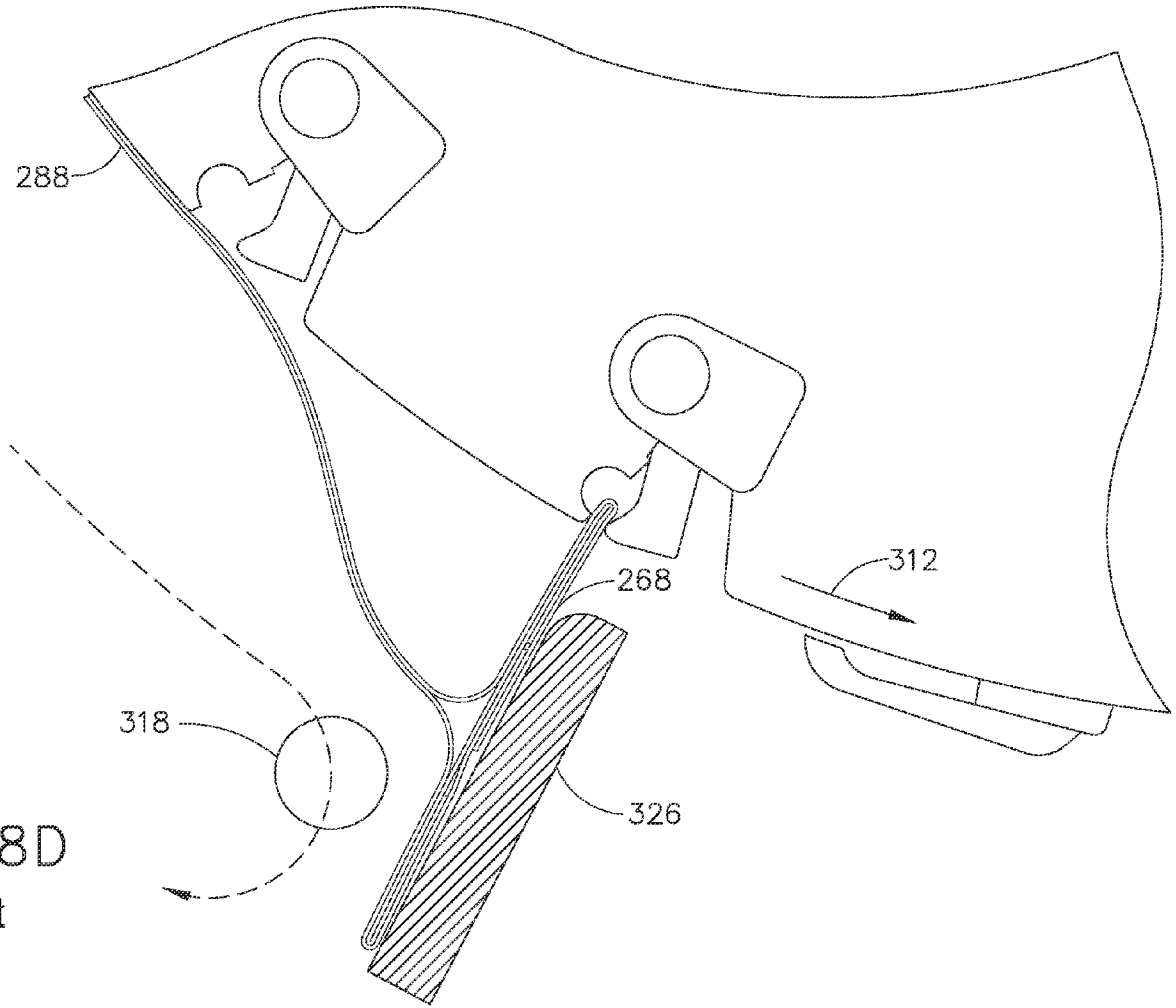
FIG. 8D Prior Art
FIG. 8D is a drawing showing a bottom closing plate closing the outer flap of a paper bag.

As shown in FIG. 8B the bottom closing roller 318, moving faster than the bottoming drum 314, folds the inner flap 266 of the cut gusseted tube 288 as it pushes the inner flap 266 downward. When the bottom closing roller 318 has passed about one half the way over the inner flap 266, the second clamp 286 opens causing the inner flap 266 to spring against the roller. As shown in FIG. 8C the bottom closing roller 318 continues to move in the direction of arrow 324, away from the bottoming drum. As the roller 318 moves out of the way as shown in FIG. 8D, the outer flap 268 continues to move forward with the bottoming drum in the direction of arrow 312. A stationary bottom closing plate 326 pushes the outer flap 268 against the inner flap 266.

A paper bag bottoming mechanism using a clampless device 350 in place of the second clamp is used to make a bag without the crease 278 caused by the second clamp. Thus, a bag with a smooth face 282 as shown in FIG. 5A may be produced.

Figure 9A:
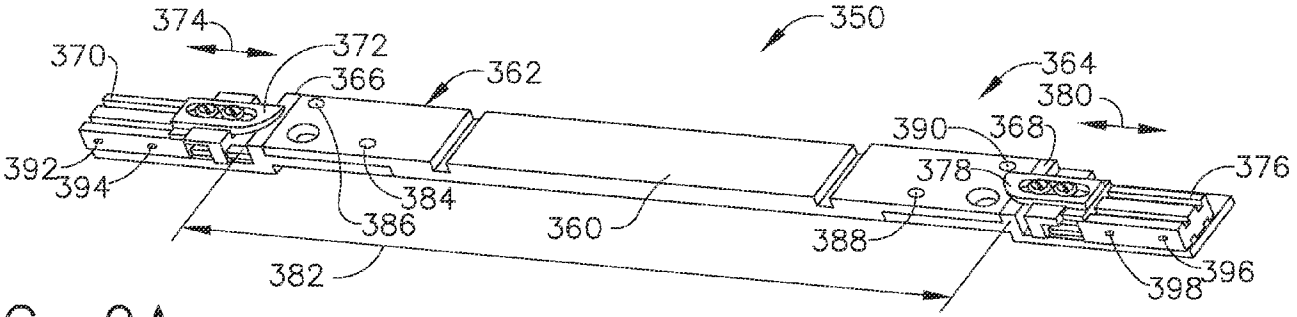
FIG. 9A is a perspective view of a clampless bar mechanism of the invention.

As shown in FIG. 9A, the clampless bar mechanism 350 includes a bar 360 having a first end 362 and a second end 364. A first guide block 366 is attached to the first end 362 and a second guide block 368 is attached to the second end 364. The first guide block 366 has a first actuating mechanism communicating with a first slideable finger 372 for actuating the first slideable finger 372 back and forth in the direction of arrow 374. The second guide block 368 has a second actuating mechanism communicating with a second slideable finger 378 for actuating the second slideable finger 378 back and forth in the direction of arrow 380. Here, the first actuating mechanism is a pneumatic cylinder 370 and the second actuating mechanism is a pneumatic cylinder 376. The first slideable finger 372 is slideably attached to the first guide block 362, and the second slideable finger 378 is slideably attached to the second guide block 368. Ports 392 and 394 provide pressurized air receiving and exhausting capabilities required for operating the first slideable finger 372 by way of the pneumatic cylinder 370, and ports 396 and 398 provide pressurized air receiving and exhausting capabilities required for operating the second slideable finger 378 by way of pneumatic cylinder 376. Other mechanisms instead of pneumatic actuators, such as solenoids or linear electric actuators, may also be used to operate the slideable fingers 372 and 378. The slideable fingers 372 and 378 in FIG. 9A are shown in the retracted position. The distance 382 is approximately the width of the bag being produced.

Figure 9B:
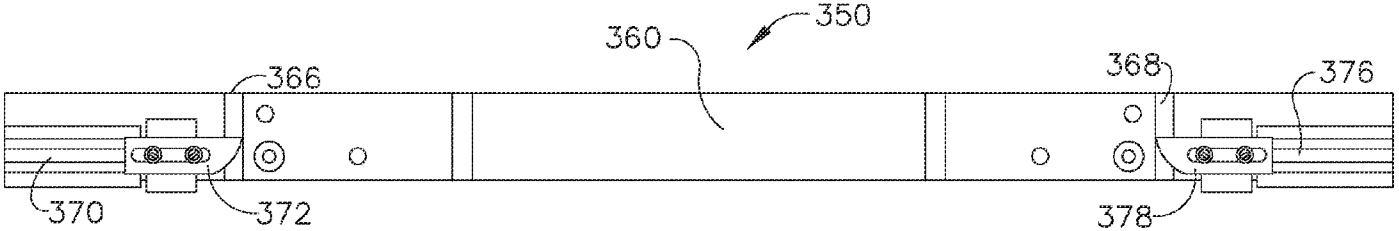
FIG. 9B is a top view of the clampless bar mechanism of FIG. 9A.
Figure 9C:
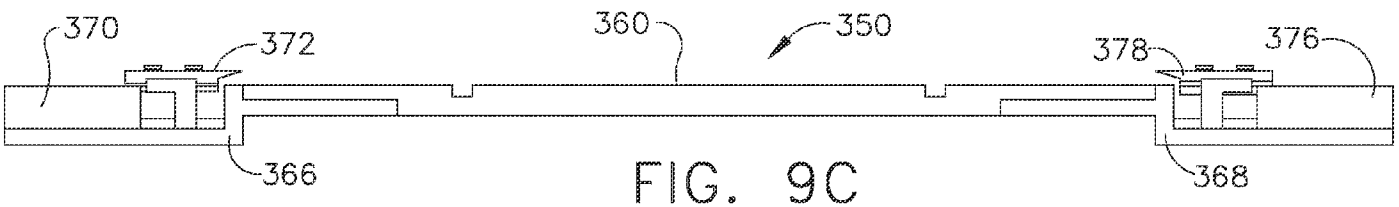
FIG. 9C is a side view of the clampless bar mechanism of FIG. 9A.
Figure 9D:
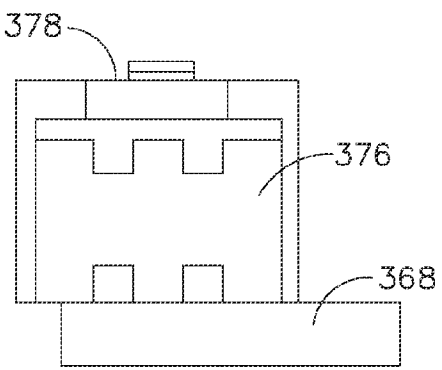
FIG. 9D is an end view of the clampless bar mechanism of FIG. 9A.

FIG. 9B shows a top view of the clampless bar mechanism 350, and FIG. 9C shows a side view of the clampless bar mechanism. FIG. 9D shows an end view of the clampless bar mechanism.

The first guide block 366 and the second guide block 368 are attached to the bar 360 by way of connections 384, 386, 388, and 390. The connections may be bolts or other connection mechanisms suitable for connecting the guide blocks to the bar. The guide blocks may be removably affixed to the bar or they may be permanently affixed to the bar. If the guide blocks are removably affixed, then various lengths of bars similar to bar 360 may be used with the guide blocks to produce bags of varying widths. Alternatively, the first and second guide blocks may be integral with the bar, and the slideable fingers and pneumatic cylinders may be connected directly to the bar. Additionally, the guide blocks having the slideable fingers and pneumatic cylinders may be affixed directly to the bottoming drum without using a bar.

Figure 10:
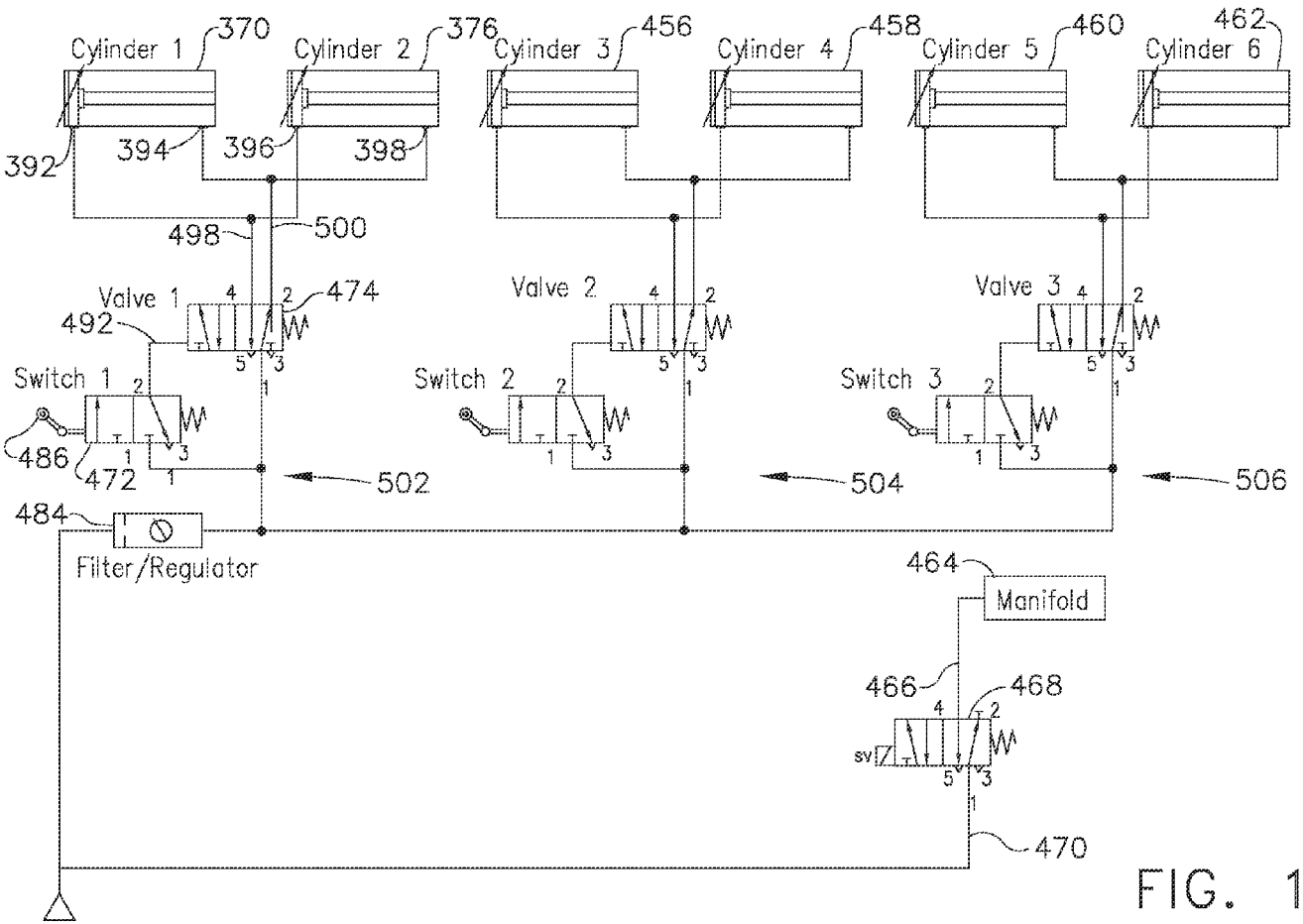
FIG. 10 is a schematic diagram of a clampless bar mechanism pneumatic control according to the invention.

FIG. 10 shows the electrical and pneumatic schematic diagram of a typical operating system utilizing three clampless bar mechanisms disposed on a bottoming drum. Cylinders 370 and 376 are mounted on the first and second guide blocks of a first bar, cylinders 456 and 458 are mounted on the first and second guide blocks of a second bar, and cylinders 460 and 462 are mounted on the first and second guide blocks of a third bar. The valves, switches, air lines, air line connections and cylinders described below for a first clamp controlling mechanism 502 are similar to a second clamp controlling mechanism 504 and to a third clamp controlling mechanism 506. Additional clamp controlling mechanism would also have similar components.

An air line 466 connects an electric valve 468 to an air manifold 464. Air line 470 connects the electric valve 468 to first switch 472 and first valve 474. The electric valve 468 is used to turn on and off the pressurized air supply to the air line 470. Alternatively, another type of valve may be used, such as a gate valve, a ball valve, or a pneumatically controlled valve. In another embodiment, no valve is used. An air filter, a regulator, or a combination thereof 484 may be installed in the air line 470. The first switch 472 is operated by cam follower 486. The cam follower rides on a cam adjacent to the bottoming drum, and the cam provides the proper timing for activating the pneumatic cylinders 370 and 376 by way of the first switch 472. Other types of synchronizing devices may also be used, such as reed switches, or electrical timing mechanisms. Also, the first switch 472 could be an electrically operated pneumatic valve. Air line 492 connects the outlet port of first switch 472 to an inlet port of valve 474. Air line 498 connects a working port on valve 474 to the cylinder bottom end ports 392 and 396 of the cylinders 370 and 376, and an air line 500 connects another working port on valve 474 to the cylinder head end ports 394 and 398 of cylinders 370 and 376.

In operation, pressurized air is provided to the first switch 472 and to the valve 474 through the air line 470. When the cam follower 486 is on the lower part of the cam, pressurized air is supplied through air line 500 to the head ends of the cylinders, causing the cylinder rod to retract. The slideable fingers affixed to the cylinder rods are then also in a retracted position. The cam is configured with lobes so that cam follower rides up on a lobe at the predetermined time when the slideable fingers should extend to secure the cut gusseted tube to the bottoming drum. Thus, when the cam follower 486 rides up on the cam lobe, the first switch 472 causes pressurized air to flow through air line 492, causing the valve 474 to provide pressurized air to line 498 and to exhaust air from the ports 394 and 398 through air line 500. Pressurized air running through line 498 causes the cylinders to extend, pushing the slideable fingers over the cut gusseted tube. When the cam follower 486 rides off the cam lobe, the first switch 472 closes, stopping pressurized air from entering line 492. The valve 474 will then allow the air in the bottom end of the cylinder to exhaust through ports 392 and 396 and line 498 and will provide pressurized air through air line 500, thus causing the cylinders and slideable fingers to retract.

Figure 11:
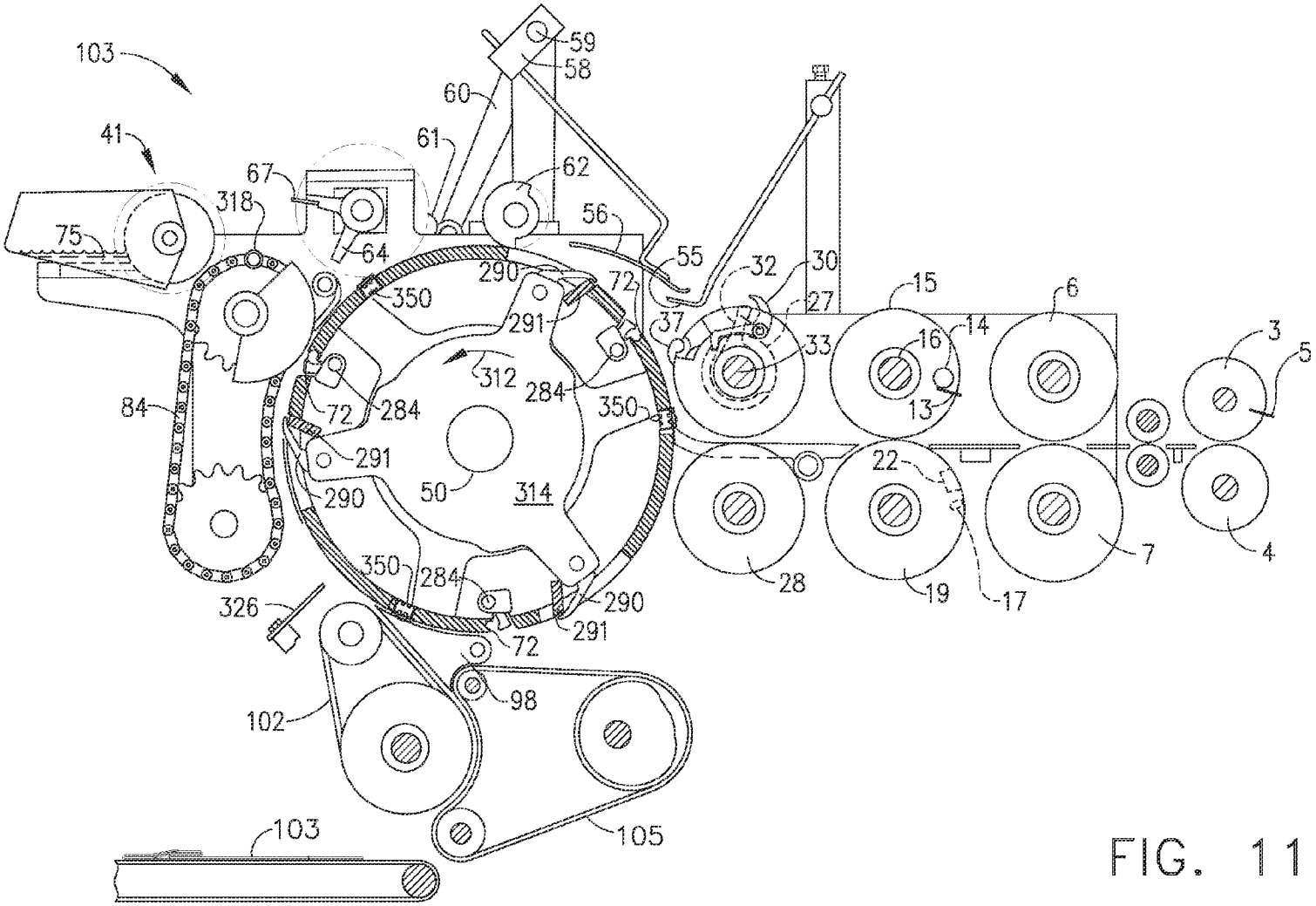
FIG. 11 is a drawing of a bag making machine of the invention.

FIG. 11 shows a bag making machine 103 which is similar to bag making machine 101 of FIG. 6, except that bag making machine 103 has the second clamp replaced by the clampless bar mechanism 350. The operations up to the tucking step proceed as described previously. Adapted with the clampless bar mechanism, the bottoming drum has a first cut gusseted tube securing mechanism and a second cut gusseted tube securing mechanism. Here, the first cut gusseted tube securing mechanism is the first clamp 284 and the second cut gusseted tube securing mechanism is the clampless bar mechanism 350.

As the cut gusseted tube rides on the bottoming drum, the first clamp 284 is held closed by its respective springs. When the cam follower that actuates the clamp rides up on a cam (not shown), the clamp is opened so it is in the open position when it arrives at the cooperating tucking blade 67. The slideable fingers 372 and 378 of the clampless bar mechanism 350 are in the retracted position.

The tucking blade 67 first engages the face of the cut gusseted tube width and forces the cut gusseted tube toward the bottoming drum between first clamp 284 and cooperating abutment 72, and the first clamp closes. The second tucking blade has been removed from its tucker bracket 69. As the bottoming drum 312 holding the cut gusseted tube continues to rotate in the direction of arrow 312, the cut gusseted tube lays across the bar of the clampless bar mechanism, whereupon a synchronizing device, such as a cam and cam follower, reed switch, or other device that can synchronize operations, operates the first switch 472. Closing the first switch 472 causes the slideable fingers to extend, slide over the cut gusseted tube, and hold the cut gusseted tube to the bottoming drum. The cut gusseted tube then moves to the paste-applying station 41, where paste 75 is applied to the face.

The inner flap 266 is then folded. Here, a second clamp is not holding the cut gusseted tube, so the inner flap does not extend outwardly from the bottoming drum. Therefore, a pressurized air device having an air inlet and outlet, such as an air knife or a hollow tube with air outlet holes disposed along the tube, is used to lift the inner flap outwardly so that it can be caught and folded by the bottom closing roller 318. This method of bottoming the bag is described later and is shown in detail in FIGS. 16A-16E. Other components, such as fingers, may be used to lift the inner flap. The bottom closing roller 318 carried by a chain 84 moves downwardly at a higher speed than the cut gusseted tube. Traveling downward, the bottom closing roller folds the inner flap 266 against the bottom side folds 270, after the inner flap 266 has been blown away from the bottoming drum. The first switch 472 is then opened by the synchronizing device, causing the slideable fingers to retract.

While the bottom closing roller 318 folds the inner flap, the outer flap 268 continues to be gripped and held down by center gripper 290. By the time the folding of the inner flap is completed, the center gripper 290 will have released the outer flap, and the outer flap will spring outwardly away from the bottoming drum and be engaged by bottom closing plate 326. Alternatively, the center gripper 290 may release prior to the folding of the inner flap. As the cut gusseted tube continues to move forward on the bottoming drum, the bottom closing plate 326 folds the outer flap against the previously folded inner flap.

The first clamp 284 then releases the cut gusseted tube. As the cut gusseted tube continues to advance, fingers 98 strip the bag from the rotating bottoming drum. The bag passes between the fingers 98 and belt 102, continuing to move forward between pressing belt 105 and belt 102. The completed bag is then discharged onto discharge belt 103.

Figure 12:
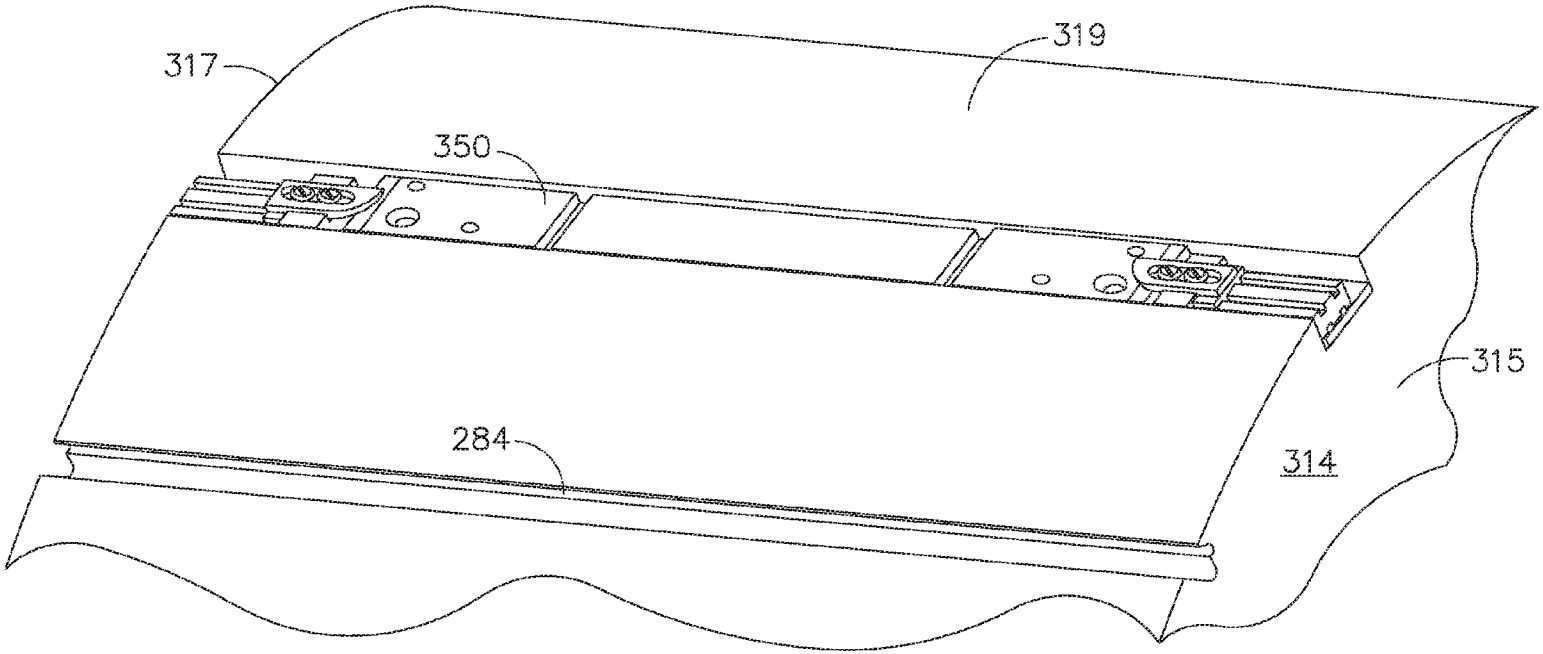
FIG. 12 is a perspective view of the clampless bar mechanism of the invention mounted to the bottoming drum.

FIG. 12 is an exploded view the clampless bar mechanism 350 with the first clamp 284 and with the bar 360 affixed to the bottoming drum 314. The bottoming drum has a first end 315, a second end 317, and a sidewall 319 disposed therebetween. Depending on the number of bags produced during each rotation of the bottoming drum, the bottoming drum may have one, two, three or more sets of first clamps and clampless bar mechanisms disposed on it between the first end 315 and the second end 317. The second gusseted tube securing mechanism, described above as the clampless bar mechanism 350, may be a first guide block 366 with an actuator and a first slideable finger 372 disposed on the first end 315 of the bottoming drum and a second guide block 368 with an actuator and second slideable finger 378 disposed on the second end 317 of the bottoming drum opposite the first guide block 366. Also, the actuators may be integral with the guide blocks.

Figure 13:
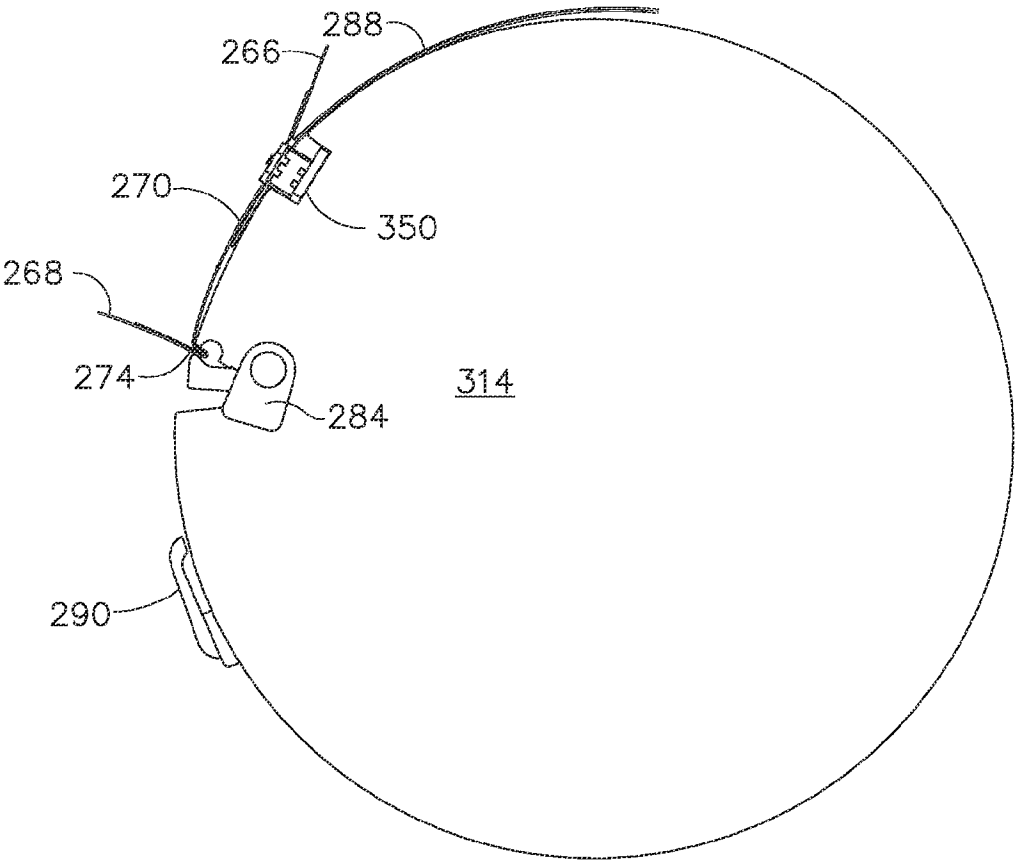
FIG. 13 is a side view of the bottoming drum having a clamp and the clampless bar mechanism of the invention holding a cut gusseted tube.

FIG. 13 shows the bottoming drum 314 after it has picked up a cut gusseted tube 288. The first clamp 284 has secured the lower portion of the cut gusseted tube, creating the crease 274 and the outwardly extending outer flap 268. Alternatively, the center gripper 290 may continue to hold the outer flap 268 against the bottoming drum 314 after the first clamp 284 has secured the cut gusseted tube. The slideable fingers of the clampless bar mechanism 350 have secured the cut gusseted tube at fold line 271 (FIG. 2), which separates the bottom side folds 270 from the inner flap 266.

Figure 14:
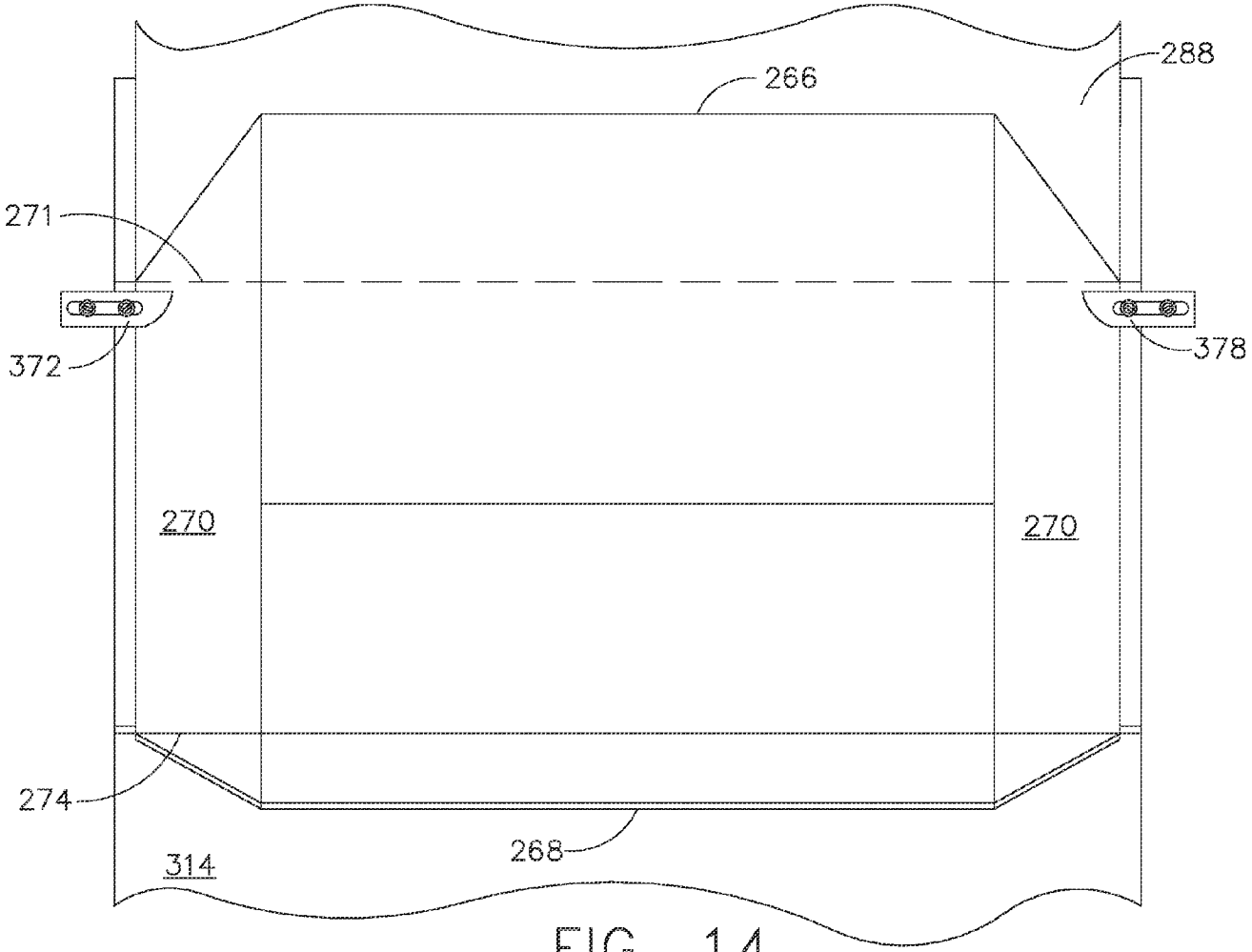
FIG. 14 is a front view of the bottoming drum having the clampless bar mechanism of the invention holding a cut gusseted tube.

FIG. 14 is a front view of the bottoming drum 314 after it has picked up a cut gusseted tube 288. The slideable fingers 372 and 378 are shown extended over the bottom side folds 270. A fold line 271 shows where the inner flap 266 will fold over and be glued to the side folds 270.

Figure 15:
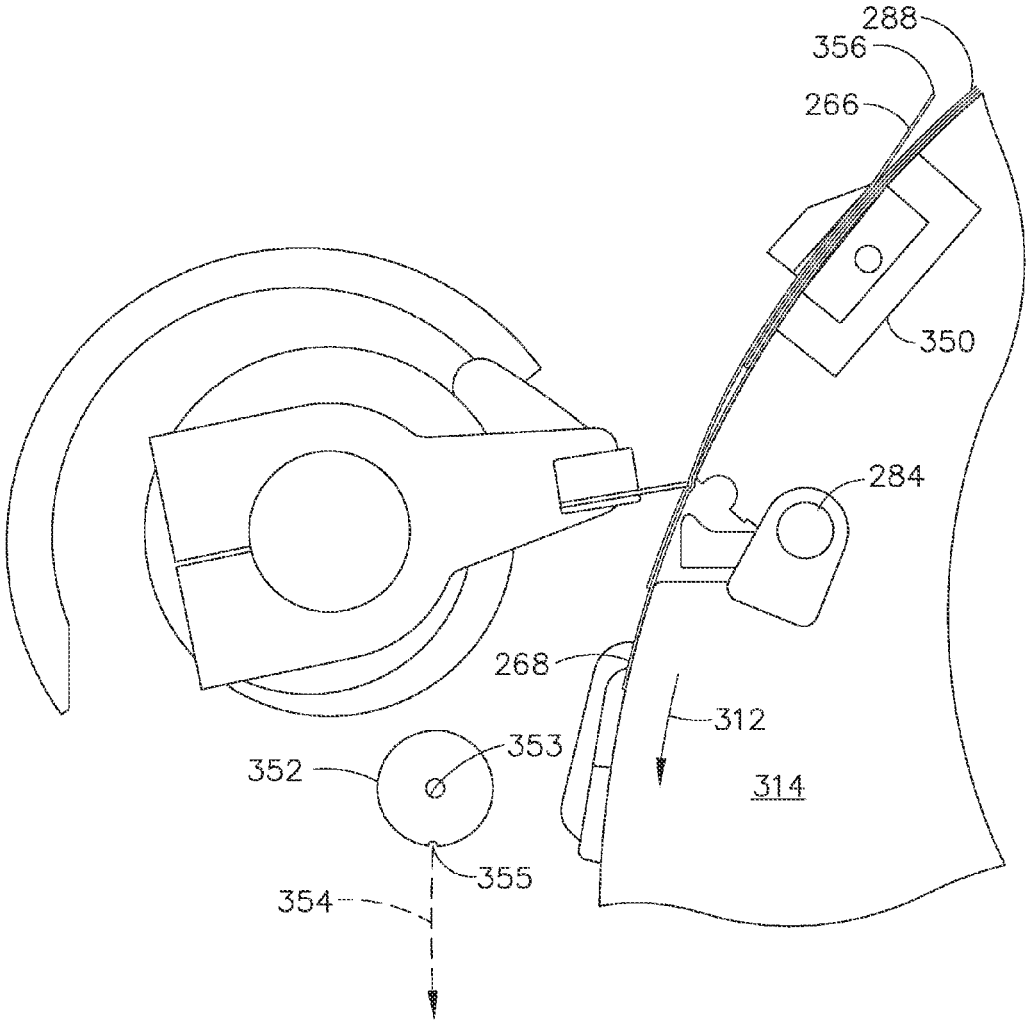
FIG. 15 is an exploded side view of the bottoming drum having a clamp and the clampless bar mechanism of the invention holding a cut gusseted tube.

FIG. 15 is an exploded view of the clampless device 350 replacing the second clamp. A cut gusseted tube 288 has the outer flap 268 extending below the first clamp 284 and the inner flap 266 extending above the clampless bar mechanism 350. A pressurized air device 352 has an air inlet 353 and an air outlet 355 and is located adjacent the bottom drum to a structure (not shown) blows air in the direction of arrow 354 as the bottoming drum 314 rotates in the direction of arrow 312. The pressurized air device may blow air continuously, or it may blow air intermittently according to predetermined timing schedule. For example, the pressurized air device may have an electrically or a cam controlled valve to time the air discharge from the pressurized air device. When the inner flap 266 passes the pressurized air device, pressurized air from the pressurized air device blows the flap 266 away from the bottoming drum so that the bottom closing roller can fold the inner flap. The pressurized air device may be adjusted to blow air at or tangentially to the bottoming drum.

Figure 16A:
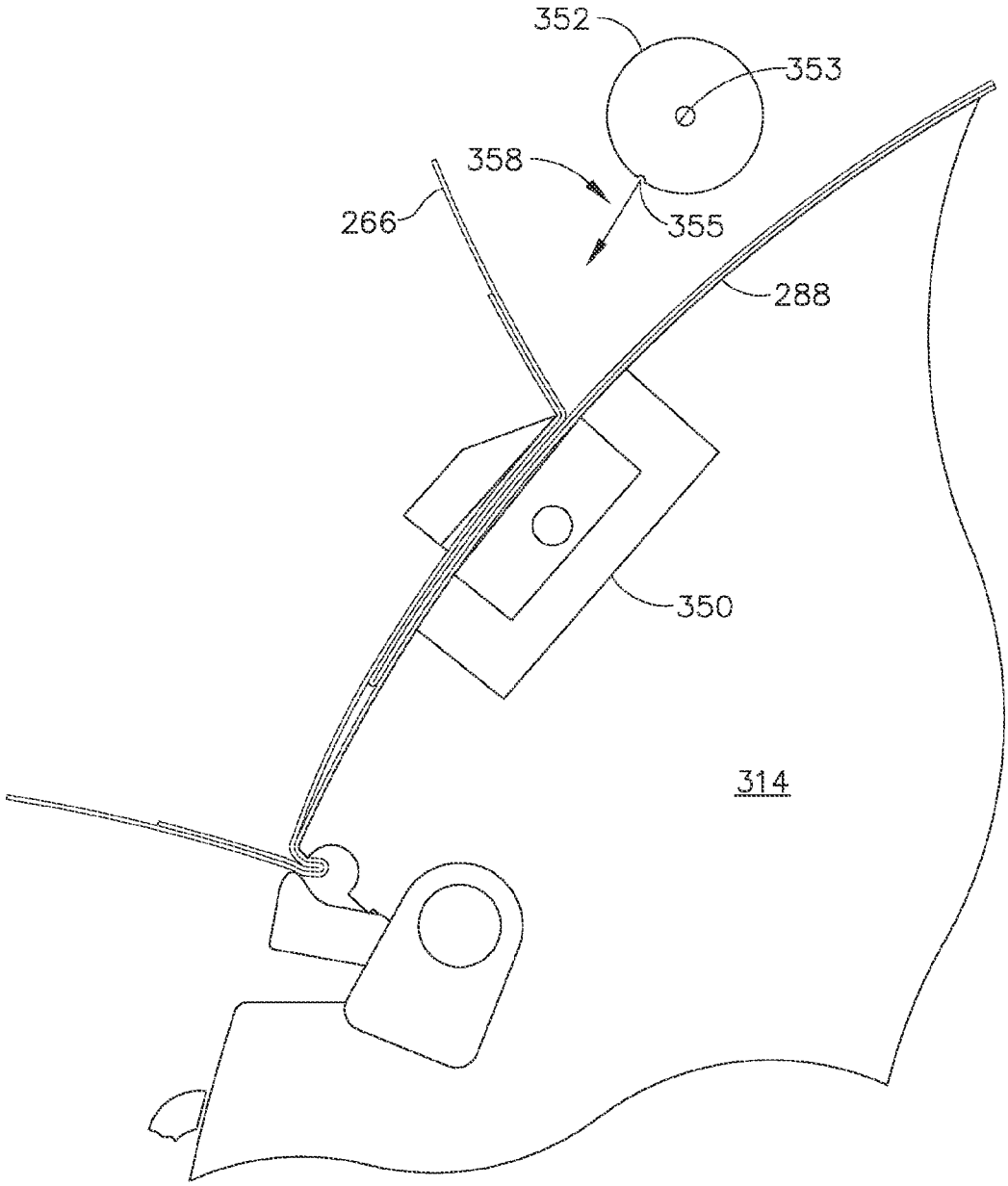
FIG. 16A is a drawing showing a pressurized air device blowing an inner flap of a cut gusseted tube held by the clampless bar mechanism of the invention.
Figure 16B:
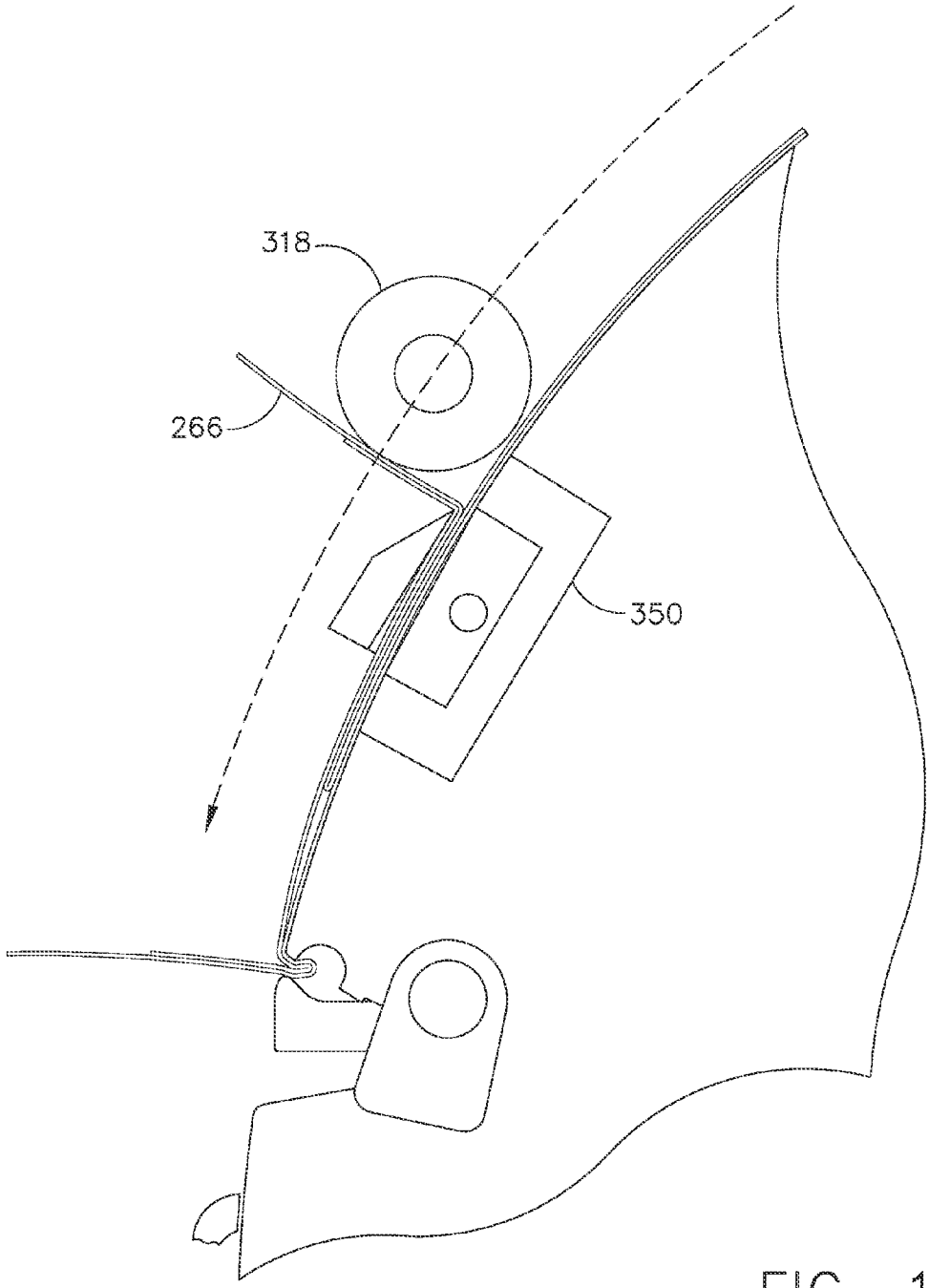
FIG. 16B is a drawing showing the bottom folding roller starting to fold the inner flap of a cut gusseted tube held by the clampless bar mechanism of the invention.
Figure 16C:
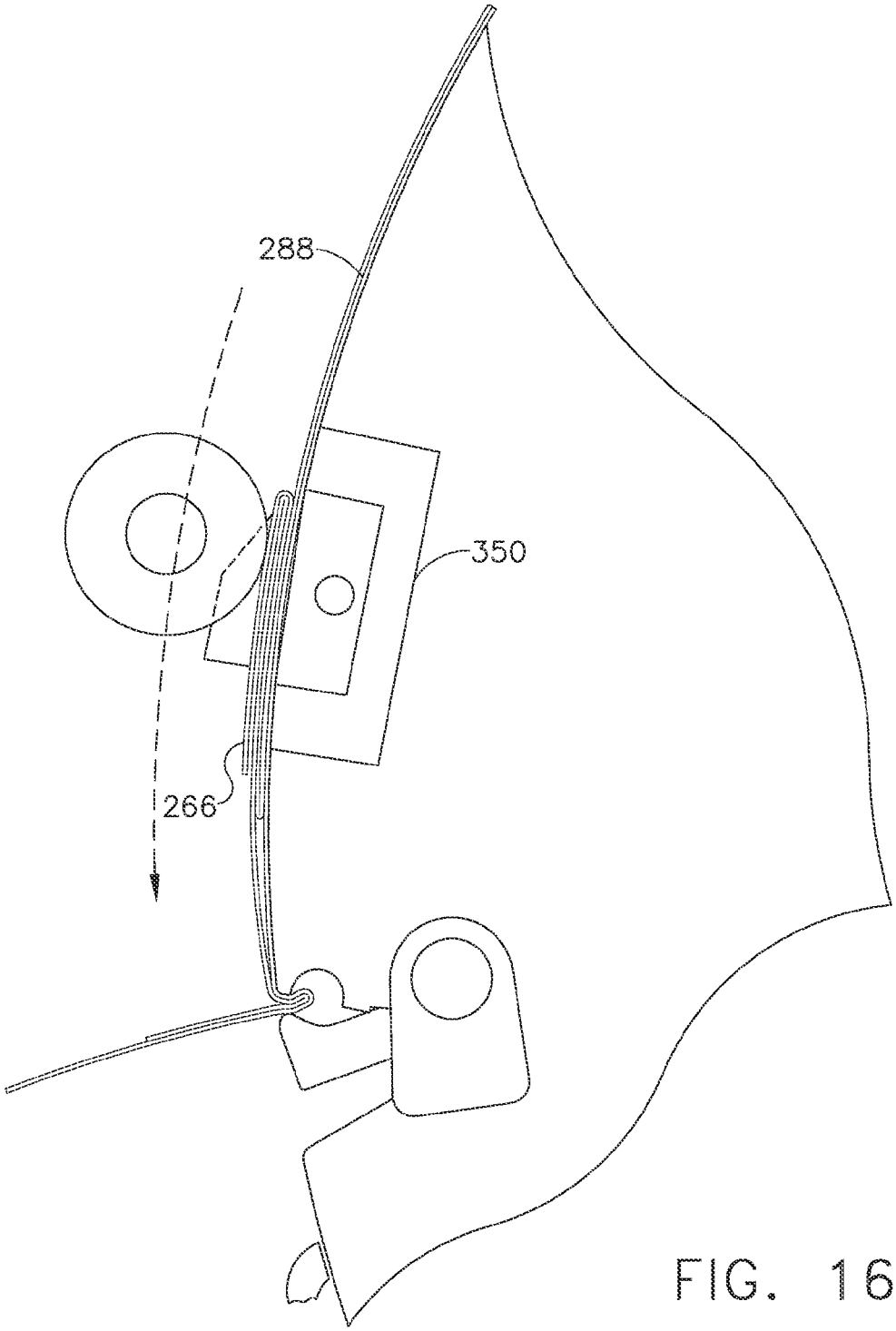
FIG. 16C is a drawing showing the bottom folding roller folding the inner flap of a cut gusseted tube according to a method of making a paper bag of the invention.
Figure 16D:
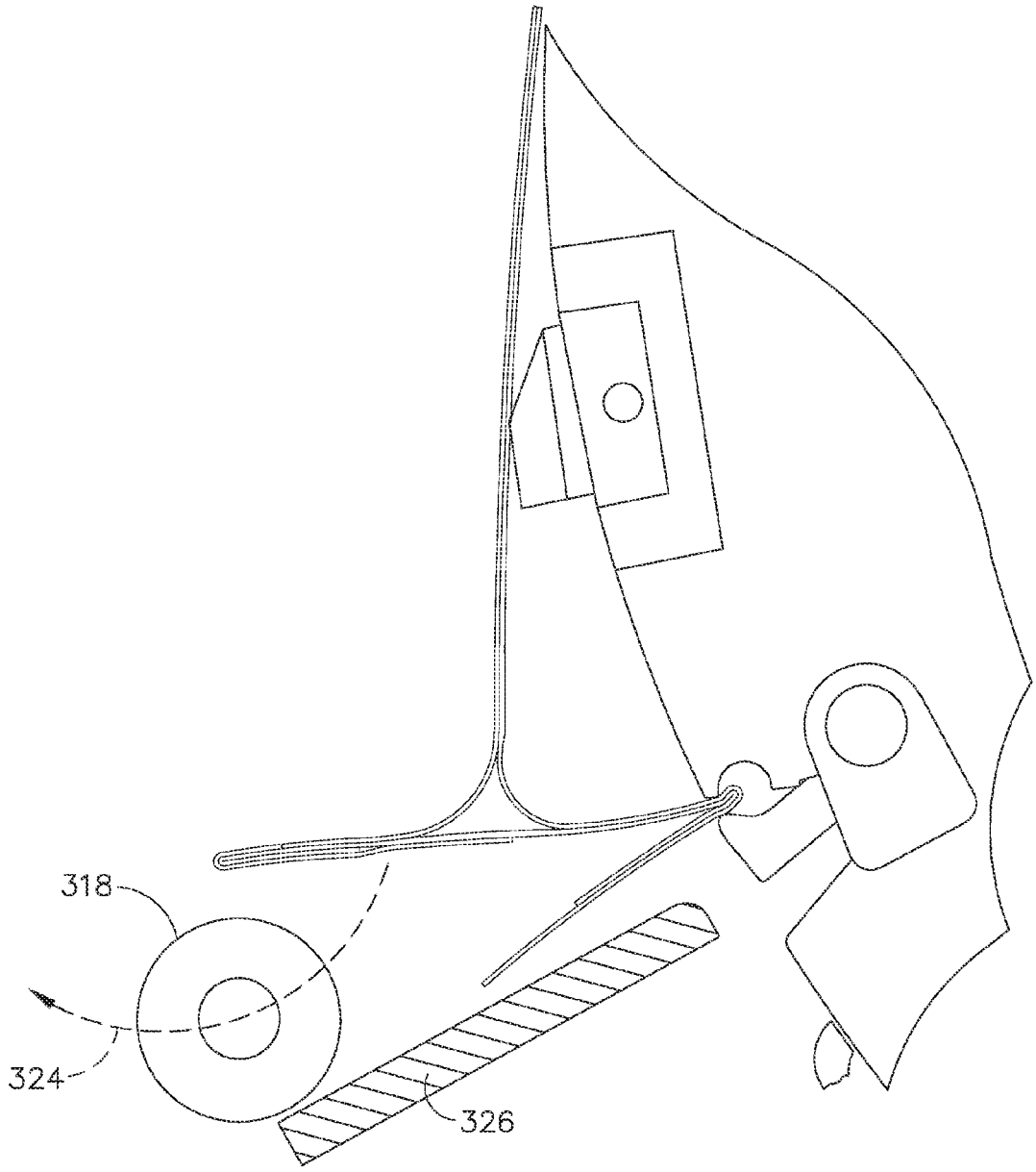
FIG. 16D is a drawing showing the bottom folding roller moving away from the bottoming drum after it has folded the inner flap of a cut gusseted tube according to a method of making a paper bag of the invention.
Figure 16E:
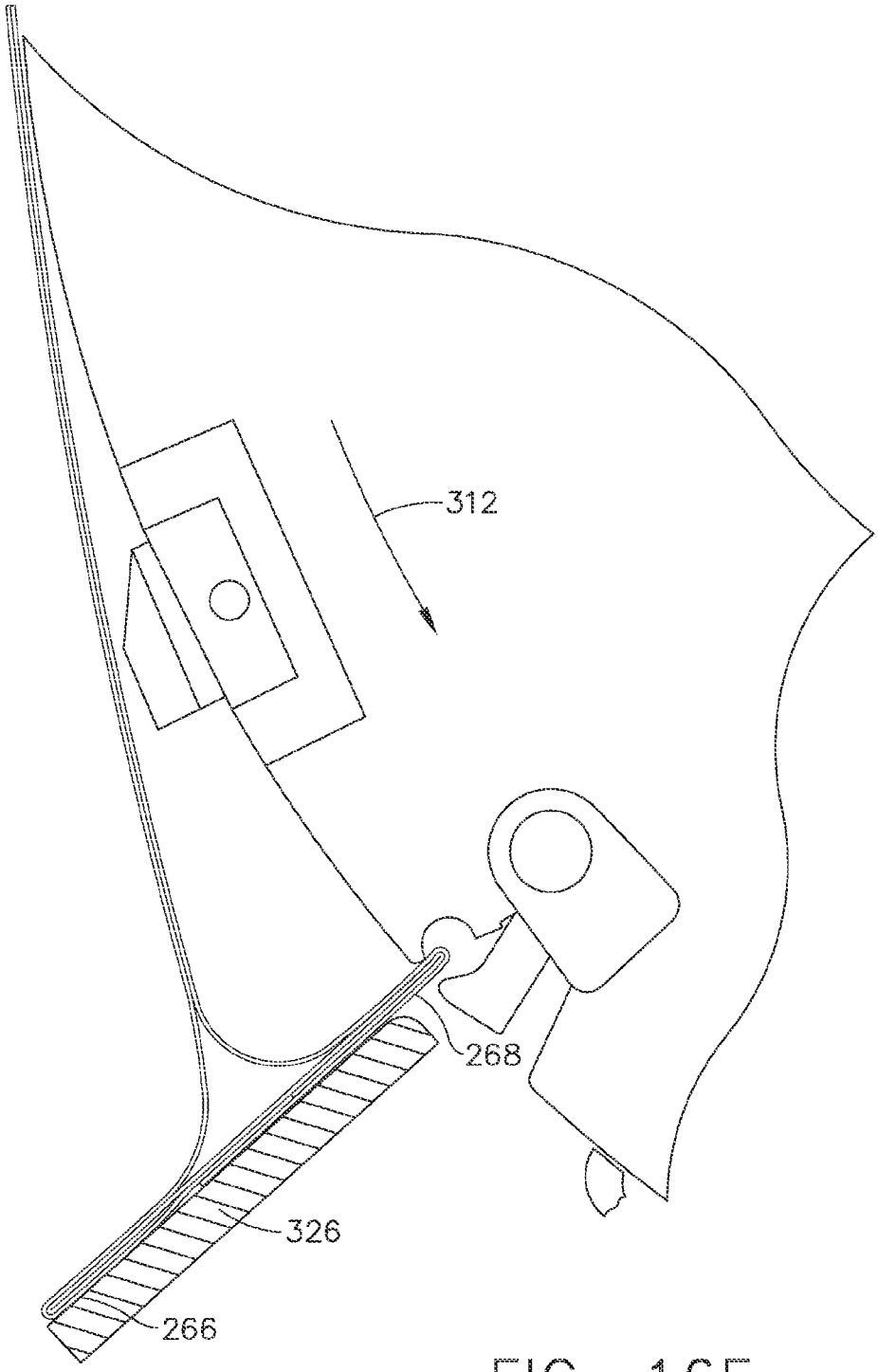
FIG. 16E is a drawing showing a bottom closing plate closing the outer flap of a cut gusseted tube according to a method of making a paper bag of the invention.

FIGS. 16A through 16E show the typical operations for closing the bottom of a cut gusseted tube using a bottoming drum with a first clamp and a clampless bar mechanism. FIG. 16A shows the clampless device 350 holding the cut gusseted tube 288 and the pressurized air device 352 blowing air in the direction arrows 358 to move the inner flap 266 away from the bottoming drum 314. FIG. 16B shows the bottom closing roller 318 starting to fold the inner flap 266. As shown in FIG. 16C the bottom closing roller 318, moving faster than the bottoming drum 314, folds the inner flap 266 of the cut gusseted tube 288 by pushing the inner flap 266 downward. When the bottom closing roller 318 has passed about one half the way over the inner flap 266, the slideable fingers on the clampless bar mechanism retract, causing the inner flap 266 to spring against the roller. As shown in FIG. 16D, the bottom closing roller 318 continues to move in the direction of arrow 324, away from the bottoming drum. After the roller 318 moves out of the way as shown in FIG. 16E, the outer flap 268 continues to move forward with the bottoming drum in the direction of arrow 312. The stationary bottom closing plate 326 pushes the outer flap 268 against the inner flap 266.

Figure 17:
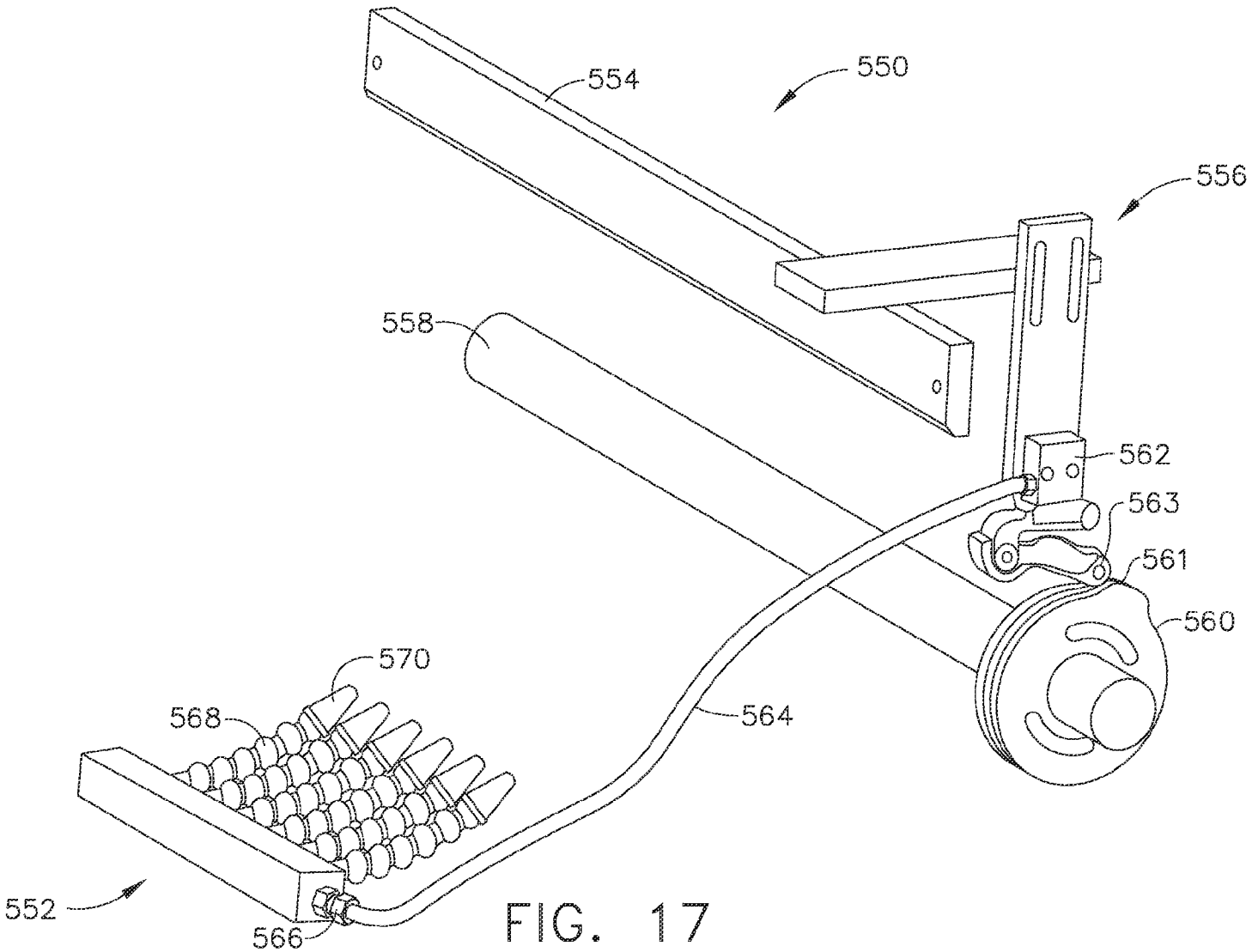
FIG. 17 is a perspective drawing showing a pressurized air system and a pressurized air device according to the invention.

FIG. 17 shows an example of a pressurized air system 550 having a pressurized air device 552. The pressurized air system 550 has a horizontal bar 554 for holding a support 556. A rotating shaft 558, synchronized with the bag making machine, drives a cam 560 with a lobe 561 that operates a cam follower 563 which controls an air valve 562. An air supply line (not shown) supplies air to the air valve 562, and an air line 564 provides pressurized air from the air valve 562 to inlet port 566 of the pressurized air device 552 when the air valve 562 is actuated by the lobe 561. Each outlet port of the pressurized air device has at least one flexible line 568 having a nozzle 570. Multiple ports may be used, and some factors that determine the number of outlet ports and flexible lines associated therewith include the type of bag being produced, the material used to make the bag, and the size of the bag.

An operator adjusts the flexible air lines 568 to direct the pressurized air to blow the inner flap 266 away from the bottoming drum. During operation, the cam 560 rotates on synchronized shaft 558, whereby the lobe 561 of the cam 560 pushes the cam follower 563 upward, opening the air valve 562 and thereby supplying pressurized air to the pressurized air device 552 through air line 564. The cam 560 provides proper timing for the pressurized air device 552 operation and conserves air by opening the air valve 562 only when pressurized air is needed to blow the inner flap away from the bottoming drum.

While the present invention has been illustrated by the description of embodiments thereof, and while the embodiments have been described in considerable detail, it is not intended to restrict or in any way limit the scope of the appended claims to such detail. Additional advantages and modifications will be readily apparent to those skilled in the art. The invention is therefore not limited to the specific details, representative apparatus and method, and illustrated examples shown and described. Accordingly, departures may be made from such details without departing from the scope or spirit of the invention.

What is claimed is:

1. A paper bag bottoming mechanism comprising:

a bottoming drum having a first end, a second end, and a sidewall disposed therebetween, a bar affixed to the bottoming drum, the bar having a first end and a second end, a first guide block attached to the first end of the bar and a second guide block attached to the second end of the bar, a first slideable finger attached to the first guide block for translational movement with respect thereto and a second slideable finger attached to the second guide block for translational movement with respect thereto, and a first actuating mechanism communicating with the first slideable finger for actuating the first slideable finger, and a second actuating mechanism communicating with the second slideable finger for actuating the second slideable finger.

2. The paper bag bottoming mechanism according to claim 1 wherein the first and second actuating mechanisms are pneumatic cylinders.

3. The paper bag bottoming mechanism according to claim 1 wherein the first and second actuating mechanisms are electrical actuators.

4. The paper bag bottoming mechanism according to claim 1 further comprising a synchronizing device communicating with the first and second actuating mechanisms for controlling actuator timing.

5. The paper bag bottoming mechanism according to claim 1 further comprising a pressurized air device having an air inlet and an air outlet, the pressurized air device located adjacent the bottoming drum.

6. The paper bag bottoming mechanism according to claim 5, wherein the outlet of the pressurized air device is orientated to blow air at the bottoming drum sidewall.

7. The paper bag bottoming mechanism according to claim 5, wherein the outlet of the pressurized air device is orientated to blow air along tangentially to the bottoming drum sidewall.

* * * * *